US008280295B2

(12) United States Patent
Naruse et al.

(10) Patent No.: US 8,280,295 B2
(45) Date of Patent: Oct. 2, 2012

(54) CLEANING DEVICE, IMAGE FORMING APPARATUS INCLUDING THE DEVICE, AND PROCESS CARTRIDGE INCLUDING THE DEVICE

(75) Inventors: Osamu Naruse, Yokohama (JP); Hidetoshi Yano, Yokohama (JP); Naomi Sugimoto, Kawasaki (JP); Kenji Sugiura, Yokohama (JP); Yasuyuki Yamashita, Zama (JP)

(73) Assignee: Ricoh Company, Limited, Tokyo (JP)

( * ) Notice: Subject to any disclaimer, the term of this patent is extended or adjusted under 35 U.S.C. 154(b) by 675 days.

(21) Appl. No.: 12/137,158

(22) Filed: Jun. 11, 2008

(65) Prior Publication Data

US 2008/0310897 A1 Dec. 18, 2008

(30) Foreign Application Priority Data

Jun. 12, 2007 (JP) ..... 2007-155716

(51) Int. Cl.
*G03G 15/00* (2006.01)
*G03G 21/00* (2006.01)

(52) U.S. Cl. ..... 399/353; 399/71; 399/354

(58) Field of Classification Search ..... 399/353, 399/354

See application file for complete search history.

(56) References Cited

U.S. PATENT DOCUMENTS 4,469,435 A * 9/1984 Nosaki et al. ..... 399/148
4,634,647 A * 1/1987 Jansen et al. ..... 430/84
5,212,530 A 5/1993 Harada et al.
5,514,508 A * 5/1996 Fukami et al. ..... 430/76
5,526,100 A 6/1996 Misago et al.
5,592,267 A 1/1997 Misago et al.
5,606,408 A 2/1997 Yano et al.
5,619,316 A 4/1997 Shoji et al.
5,740,494 A 4/1998 Shoji et al.
5,765,087 A 6/1998 Yano et al.
5,999,773 A 12/1999 Yasutomi et al.
6,799,012 B2 9/2004 Shakuto et al.

(Continued)

FOREIGN PATENT DOCUMENTS

JP 2-42230 9/1990

(Continued)

OTHER PUBLICATIONS

Machine translation of JP 2005275085 A.*

(Continued)

*Primary Examiner* — Walter L Lindsay, Jr.
*Assistant Examiner* — David Bolduc
(74) *Attorney, Agent, or Firm* — Oblon, Spivak, McClelland, Maier & Neustadt, L.L.P.

(57) ABSTRACT

A cleaning device includes a cleaning member, a collection member, an electrical field generator, and a separation member. The cleaning member has a surface capable of moving while contacting a surface of a cleaning target to remove toner on the surface of the cleaning target. The collection member has a surface capable of moving while contacting the surface of the cleaning member to collect the toner on the surface of the cleaning member. The electrical field generator generates an electrical field to move the toner from the cleaning member to the collection member. The separation member contacts the surface of the collection member to separate the toner on the surface of the collection member. The collection member has a centerline average surface roughness of not more than 0.1 μm and shows a surface hardness rank of B or higher in a steel-wool scratch test.

19 Claims, 13 Drawing Sheets

U.S. PATENT DOCUMENTS

| | | | | |
|---|---|---|---|---|
| 6,987,944 | B2 | 1/2006 | Shakuto et al. | |
| 7,062,212 | B2 | 6/2006 | Naruse et al. | |
| 7,103,301 | B2 | 9/2006 | Watanabe et al. | |
| 7,123,872 | B2 | 10/2006 | Shakuto et al. | |
| 7,184,699 | B2 | 2/2007 | Naruse et al. | |
| 7,209,699 | B2 | 4/2007 | Yamaguchi et al. | |
| 7,369,807 | B2 | 5/2008 | Naruse et al. | |
| 2001/0018003 | A1 | 8/2001 | Waterschoot | |
| 2001/0051312 | A1* | 12/2001 | Itami et al. | 430/125 |
| 2002/0081130 | A1* | 6/2002 | Endo et al. | 399/349 |
| 2003/0031489 | A1 | 2/2003 | Maher et al. | |
| 2004/0042821 | A1* | 3/2004 | Onishi et al. | 399/127 |
| 2004/0197122 | A1 | 10/2004 | Nakano et al. | |
| 2005/0058474 | A1* | 3/2005 | Watanabe et al. | 399/353 |
| 2005/0254868 | A1* | 11/2005 | Naruse et al. | 399/350 |
| 2006/0099016 | A1 | 5/2006 | Watanabe et al. | |
| 2006/0133872 | A1 | 6/2006 | Sugiura et al. | |
| 2006/0285897 | A1 | 12/2006 | Sugiura et al. | |
| 2006/0285898 | A1 | 12/2006 | Watanabe et al. | |
| 2007/0003337 | A1 | 1/2007 | Shakuto et al. | |
| 2007/0166087 | A1 | 7/2007 | Yamaguchi et al. | |
| 2007/0212139 | A1* | 9/2007 | Sugiura et al. | 399/353 |
| 2008/0193179 | A1* | 8/2008 | Sugimoto et al. | 399/354 |
| 2009/0226203 | A1* | 9/2009 | Pozniakas et al. | 399/71 |

FOREIGN PATENT DOCUMENTS

| | | | |
|---|---|---|---|
| JP | 8-54814 | | 2/1996 |
| JP | 10-69196 | | 3/1998 |
| JP | 2000155512 | A * | 6/2000 |
| JP | 2003-57913 | | 2/2003 |
| JP | 2004-53893 | | 2/2004 |
| JP | 2004-184863 | | 7/2004 |
| JP | 2005-17764 | | 1/2005 |
| JP | 2005-265907 | | 9/2005 |
| JP | 2005275085 | A * | 10/2005 |
| JP | 3904184 | | 1/2007 |
| JP | 2007-101683 | | 4/2007 |
| JP | 2007101683 | A * | 4/2007 |

OTHER PUBLICATIONS

Machine translation of JP 2007101683 A.*
English abstract of JP 2000155512 A.*
English abstract of JP 2000155512 A, Jun. 2000.*
Machine translation of JP 2007101683 A, Apr. 2007.*
Machine translation of JP 2005275085 A, Oct. 2005.*
Anonymous, "Polyurethane—Hard Cast Elastomer", The A to Z of Materials, [Online], XP-002492433, http://www.azom.com/details.asp?ArticleID=683>, Retrieved on Aug. 18, 2008, pp. 1-2.

* cited by examiner

CLEANING DEVICE, IMAGE FORMING APPARATUS INCLUDING THE DEVICE, AND PROCESS CARTRIDGE INCLUDING THE DEVICE

CROSS-REFERENCE TO RELATED APPLICATIONS

The present patent application claims priority under 35 U.S.C. §119 from Japanese Patent Application No. 2007-155716, filed on Jun. 12, 2007 in the Japan Patent Office, the entire contents of which are hereby incorporated herein by reference.

BACKGROUND OF THE INVENTION

1. Field of the Invention

The present invention relates to a cleaning device; an image forming apparatus, such as a copier, a printer, or a facsimile, including the cleaning device; and a process cartridge including the cleaning device.

2. Description of the Background

Image forming apparatuses are used as copiers, facsimile machines, printers, and multi-functional devices combining several of the foregoing capabilities, including electrophotographic image forming apparatuses.

Typically, such electrophotographic image forming apparatuses have a cleaning device to remove excess or residual toner remaining on a surface of an image bearing member after transferring a toner image from the image bearing member, such as a latent image bearing member or an intermediate transfer body.

For such cleaning device, a blade system that scrapes away excess toner with a cleaning blade is extensively used because of its simple configuration and excellent cleaning performance. Such blade system is capable of mechanically scraping the surface of an image bearing member with relatively great force, thereby effectively preventing so-called "filming". Here, the term "filming" refers to a phenomenon in which additives such as silica and zinc stearate are detached from a toner body due to mechanical stress during an image forming process and are attached to the surface of the image bearing member to form a thin film. Such filming may reduce the adhesion force of toner to the surface of the image bearing member, thereby resulting in an image failure such as image flow.

Recently, many attempts have been made to reduce the particle diameter of toner in order to obtain higher image quality. In particular, certain types of toner particles are formed in a substantially round shape by a polymerization method to reduce cost. Such substantially round-shaped toner (hereinafter "round toner") has certain advantages, such as relatively high transfer efficiency, over a conventional type of ground toner (hereinafter, "irregular toner"). As a result, such round toner may simultaneously satisfy the demand for high image quality and reduce the amount of toner discarded as residual toner.

However, when such minute and/or round toner is cleaned with a blade system as described above, it may be difficult to completely scrape off such toner with a cleaning blade because a certain portion of the toner particles passes under the cleaning blade. In such case, the cleaning blade needs to be pressed against a surface of an image bearing member with relatively greater force than when irregular toner is used. Accordingly, the cleaning blade and/or the surface of the image bearing member may be further abraded, thereby reducing the service life of the cleaning blade and/or the image bearing member. Consequently, such abrasion may also increase the driving load on the drive mechanism for moving the surface of the image bearing member, which is undesirable.

One method of effectively cleaning such minute and/or round toner proposes using an electrostatic cleaning system to clean such toner remaining on the surface of the image bearing member by electrostatic action. A description of such electrostatic action is given below, with reference to FIG. 1.

In this regard, a typical electrophotographic image forming apparatus generally supplies a bias of a polarity opposite a (normal) polarity of toner attached to a surface of an image bearing member so as to transfer the toner on the surface of the image bearing member onto a transfer member, such as a recording medium. As a result, residual toner remaining on the surface of the image bearing member after the transfer process may include both normal-polarity toner and opposite-polarity toner, as shown in a low charge area of FIG. 1. In such case, when employing the electrostatic cleaning method, such image forming apparatus must be capable of electrostatically collecting both the normal-polarity toner and opposite-polarity toner.

FIG. 2 is a schematic view illustrating a conventional type of cleaning device 170 employing an electrostatic cleaning system.

In FIG. 2, the cleaning device 170 has a first conductive brush roller 171 to which a voltage of positive polarity is applied and a second conductive brush roller 172 to which a voltage of negative polarity is applied. In the cleaning device 170, the first conductive brush roller 171 and the second conductive brush roller 172 are arranged along a travel direction of a surface of a photoconductor 1*a* functioning as an image bearing member. The first conductive brush roller 171 removes negatively charged toner, and the second conductive brush roller 172 removes positively charged toner. Then, the toner attached to the brush rollers 171 and 172 is removed by collection rollers 173 and 174, respectively. The toner attached to the collection rollers 173 and 174 is then removed from the surfaces of the collection rollers 173 and 174 with corresponding collection blades.

Alternatively, another conventional type of cleaning device is capable of cleaning both positive-polarity toner and negative-polarity toner with a single brush roller.

In such single-brush roller conventional cleaning device, a plurality of conductive bristles forming part of the brush roller includes a first area to which a bias of positive polarity is applied and a second area to which a bias of negative polarity is applied. Rotating the brush roller causes the first area of positive polarity and the second area of negative polarity to contact a surface of an image bearing member. Thus, negatively charged toner is removed by the first area, while positively charged toner is removed by the second area. The toner attached to the brush roller is removed from a surface of the brush roller with a collection roller. The toner attached to the collection roller is then removed from a surface of the collection roller with a collection-roller blade.

However, in the case of using such minute and/or round toner, when the toner attached to the surface of the collection member such as the collection roller is cleaned with the separation member such as the collection-roller blade, a problem similar to that of the above-described case where the toner on the photoconductor is cleaned with the cleaning blade may occur. That is, the separation member may not completely scrape away such toner, thereby resulting in a cleaning failure on the surface of the collection member. Such cleaning failure may reduce the collection efficiency of toner from the cleaning roller such as the brush roller, thereby reducing the cleaning performance of the cleaning member for the surface of the photoconductor. Therefore, it is necessary to prevent a cleaning failure of the surface of the collection member in some way.

Pressing the separation member against the surface of the collection member with a relatively greater force may enhance the cleaning performance of the separation member for the surface of the collection member, and thus, in the short term, a cleaning failure can be prevented from occurring when such minute and/or round toner is used. However, in such case, a large friction force may be generated between the separation member and the surface of the collection member, thereby resulting in further abrasion of the separation member and the surface of the collection member and a reduction in the friction coefficient therebetween. Consequently, in the long term, a portion of toner may pass between the separation member and the surface of the collection member, thereby resulting in a cleaning failure.

The above-described cleaning failure may also occur in, for example, a configuration in which toner attached to a movable surface of a cleaning member is collected with a smoothly movable surface of a collection member and then the toner attached to the surface of the collection member is removed by a separation member disposed to press against the surface of the collection member.

Accordingly, in such configuration, even when toner on a surface of an image bearing member is mechanically removed without applying a bias to the cleaning member having the movable surface, a cleaning failure similar to that described above may occur. Alternatively, for example, even when a surface moving member such as a recording-medium transport member is cleaned, a cleaning failure similar to that described above may occur.

Consequently, there remains a need for a cleaning device capable of preventing a cleaning failure from occurring on a surface of a collection member in the long term, and an image forming apparatus and a process cartridge including such cleaning device.

SUMMARY OF THE INVENTION

Exemplary embodiments of the present invention provide a cleaning device capable of preventing a cleaning failure from occurring on a surface of a collection member in a long term, and an image forming apparatus and a process cartridge including such cleaning device.

In one exemplary embodiment of the present invention, a cleaning device, which removes toner on a cleaning target, includes a cleaning member, a collection member, an electrical field generator, and a separation member. The cleaning member has a surface capable of moving while contacting a surface of the cleaning target to remove toner having a given polarity on the surface of the cleaning target. The collection member has a surface capable of moving while contacting the surface of the cleaning member to collect the toner attached to the surface of the cleaning member. The electrical field generator generates an electrical field to move the toner attached to the surface of the cleaning member from the cleaning member to the collection member at a contact portion between the cleaning member and the collection member. The separation member is disposed to contact the surface of the collection member to separate the toner attached to the surface of the collection member from the surface of the collection member. The collection member has a centerline average surface roughness of not more than 0.1 μm and shows a surface hardness rank of B or higher in a steel-wool scratch test.

In another exemplary embodiment of the present invention, an image forming apparatus includes an image bearing member, an image forming unit, a cleaning device, and a transfer unit. The image bearing member has a movable surface. The image forming unit forms a toner image on the surface of the image bearing member. The cleaning device removes toner on the surface of the image bearing member. The transfer unit transfers the toner image on the surface of the image bearing member to a recording medium to form a final image on the recording medium. The cleaning device includes a cleaning member, a collection member, an electrical field generator, and a separation member. The cleaning member has a surface capable of moving while contacting the surface of the image bearing member to remove toner having a given polarity on the surface of the image bearing member. The collection member has a surface capable of moving while contacting the surface of the cleaning member to collect the toner attached to the surface of the cleaning member. The electrical field generator generates an electrical field to move the toner attached to the surface of the cleaning member from the cleaning member to the collection member at a contact portion between the cleaning member and the collection member. The separation member is disposed to contact the surface of the collection member to separate the toner attached to the surface of the collection member from the surface of the collection member. The collection member has a centerline average surface roughness of not more than 0.1 μm and shows a surface hardness rank of B or higher in a steel-wool scratch test.

In still another exemplary embodiment of the present invention, a process cartridge detachably mountable to an image forming apparatus includes an image bearing member and a cleaning device. The image bearing member has a movable surface. The cleaning device removes toner attached to the surface of the image bearing member. The cleaning device and the image bearing member are integrally held in the process cartridge. The cleaning device includes a cleaning member, a collection member, an electrical field generator, and a separation member. The cleaning member has a surface capable of moving while contacting the surface of the image bearing member to remove toner having a given polarity on the surface of the image bearing member. The collection member has a surface capable of moving while contacting the surface of the cleaning member to collect the toner attached to the surface of the cleaning member. The electrical field generator generates an electrical field to move the toner attached to the surface of the cleaning member from the cleaning member to the collection member at a contact portion between the cleaning member and the collection member. The separation member is disposed to contact the surface of the collection member to separate the toner attached to the surface of the collection member from the surface of the collection member. The collection member has a centerline average surface roughness of not more than 0.1 μm and shows a surface hardness rank of B or higher in a steel-wool scratch test.

BRIEF DESCRIPTION OF THE DRAWINGS

A more complete appreciation of the disclosure and many of the attendant advantages thereof will be readily acquired as the same becomes better understood by reference to the following detailed description when considered in connection with the accompanying drawings, wherein.

Figure 1:
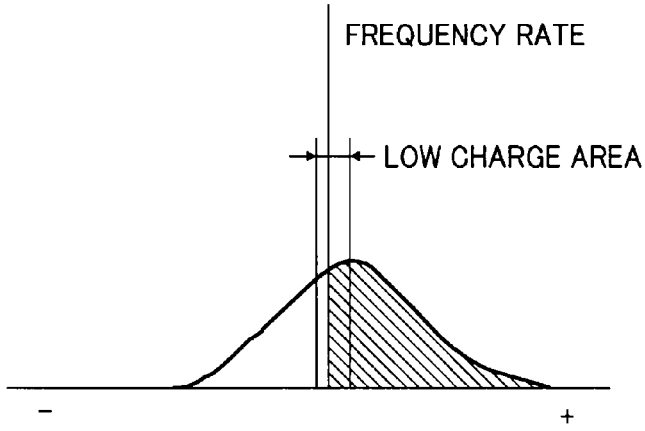
FIG. 1 illustrates a charging distribution of residual toner remaining on a photoconductor after a transfer process.
Figure 2:
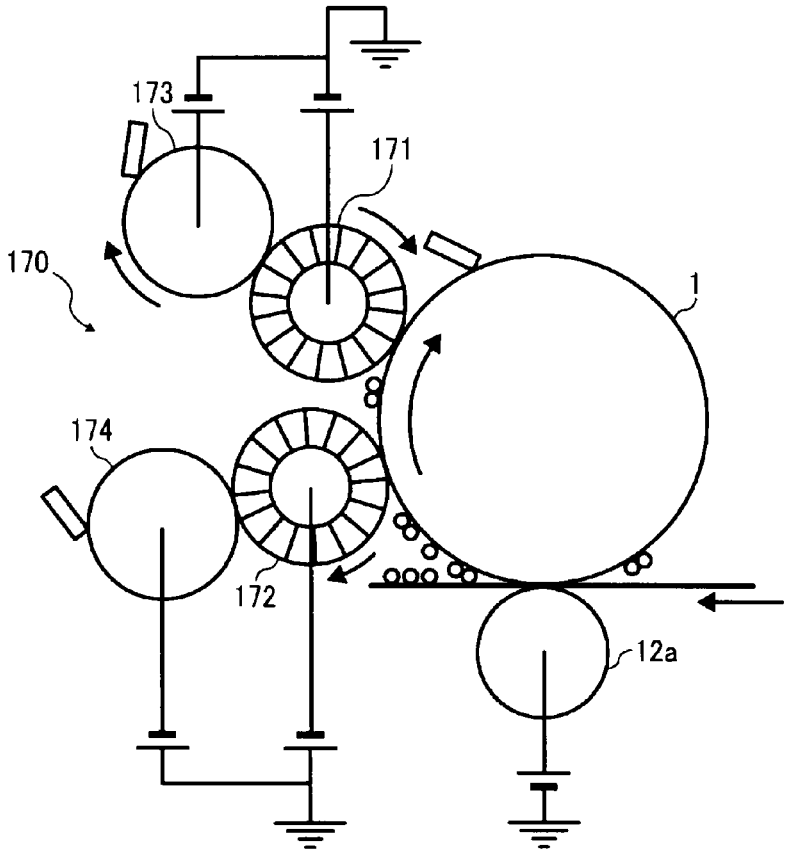
FIG. 2 RELATED ART
FIG. 2 is a schematic view illustrating a configuration of a main portion of a conventional cleaning device.

The accompanying drawings are intended to depict exemplary embodiments of the present disclosure and should not be interpreted to limit the scope thereof. The accompanying drawings are not to be considered as drawn to scale unless explicitly noted.

DETAILED DESCRIPTION OF EXEMPLARY EMBODIMENTS

In describing exemplary embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner and achieve the same results. For the sake of simplicity, the same reference numerals are used in the drawings and the descriptions for the same materials and constituent parts having the same functions, and redundant descriptions thereof are omitted.

Exemplary embodiments of the present disclosure are now described below with reference to the accompanying drawings. It should be noted that, in a later-described comparative example, exemplary embodiment, and alternative example, the same reference numerals are used for the same constituent elements such as parts and materials having the same functions and achieving the same effects, and redundant descriptions thereof are omitted.

Below, an image forming apparatus according to an exemplary embodiment is described as a printer. It should be noted that exemplary embodiments are not limited to such printer, and may be a copier, a facsimile machine, and a multi-functional device combining several of the foregoing capabilities.

Figure 3:
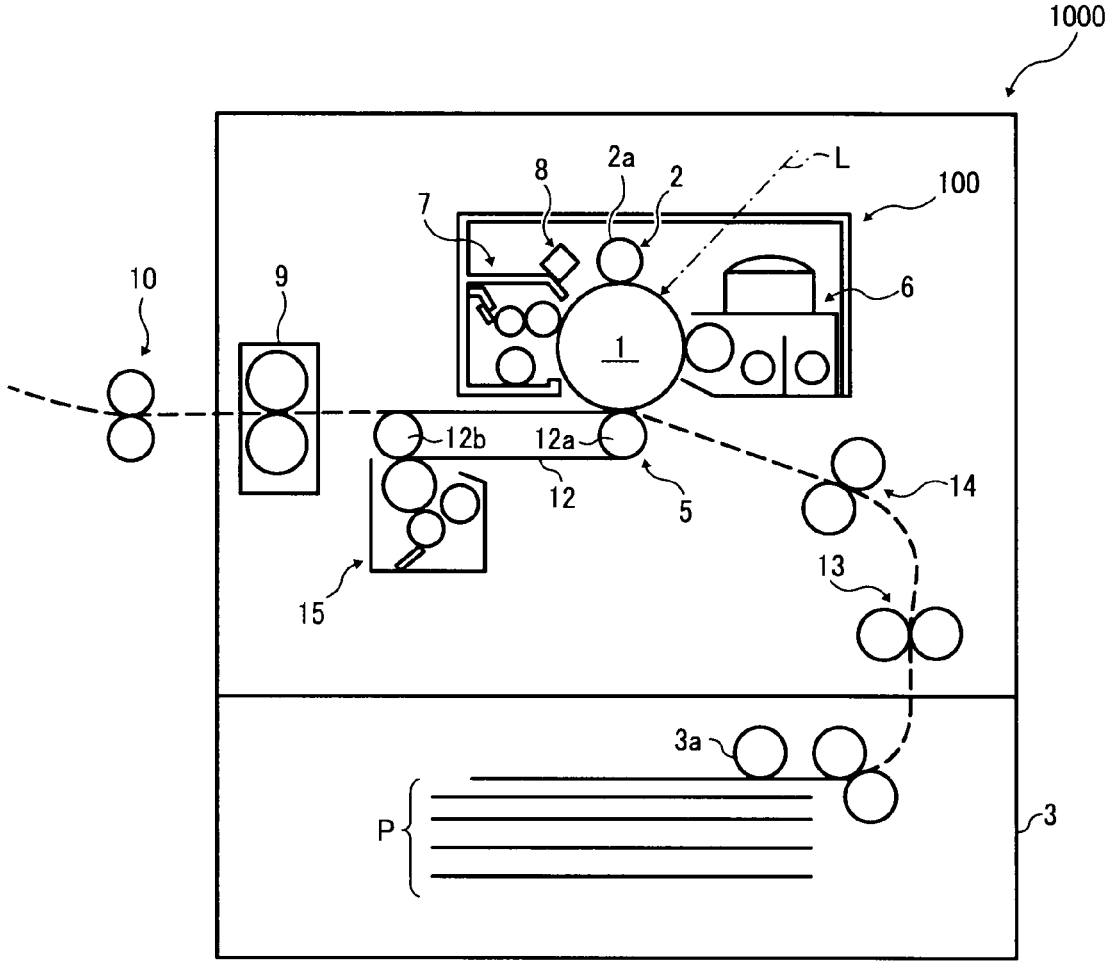
FIG. 3 is a schematic view illustrating a configuration of an image forming apparatus according to an exemplary embodiment of the present invention.

FIG. 3 illustrates a schematic configuration of an image forming apparatus 1000 according to an exemplary embodiment of the present invention.

In the image forming apparatus 1000, a photoconductor 1 is surrounded by a charging device 2, an exposure device, a transfer device 5, a developing device 6, a cleaning device 7, and an electric discharger 8.

The photoconductor 1 is the cleaning target of the cleaning device 7 and functions as an image bearing member. The charging device 2 has a charging roller 2*a* that uniformly charges a surface of the photoconductor 1. The exposure device, not illustrated, exposes the surface of the photoconductor 1 charged by the charging roller 2*a* with a laser beam L to form an electrostatic latent image on the surface of the photoconductor 1. The developing device 6 supplies toner charged with a predetermined polarity (for example, a negative polarity in this exemplary embodiment) to the electrostatic latent image on the surface of the photoconductor 1 to form a toner image on the surface of the photoconductor 1. The transfer device 5 uses a transfer roller 12*a* to transfer the toner image on the photoconductor 1 onto a transfer sheet P fed from a sheet feed cassette 3. The cleaning device 7 cleans the photoconductor 1 by removing residual toner remaining on the photoconductor 1 after the above-described transfer process. The electric discharger 8 discharges residual electric potential (electrical charge) remaining on the photoconductor 1.

In FIG. 3, below the transfer device 5 is disposed the sheet feed cassette 3 containing a stack of transfer sheets P (hereinafter "sheets" or "a sheet") serving as recording materials. The sheet feed cassette 3 presses a sheet feed roller 3*a* against a sheet P on the top of the sheet stack and rotates the sheet feed roller 3*a* at an appropriate timing to feed the sheet P to a sheet feed path.

In the sheet feed path, the sheet P passes between transport rollers 13 and then stops at registration rollers 14. The registration rollers 14 forward the sheet P toward a transfer nip formed between the transfer roller 12*a* and the photoconductor 1 at such a timing that the toner image on the photoconductor 1 is transferred on the sheet P. Then, the toner image on the photoconductor 1 is electrostatically transferred onto the sheet P by a transfer bias generated at the transfer nip between the transfer roller 12*a* and the photoconductor 1. A sheet conveyance belt 12 is extended between the transfer roller 12*a* and a driving roller 12*b* and endlessly moved in a counterclockwise direction in FIG. 3.

In FIG. 3, a fixing device 9 and ejection rollers 10 are provided at one side of the sheet conveyance belt 12. The sheet P having the toner image is conveyed to the fixing device 9 by the sheet conveyance belt 12. The fixing device 9 heats and presses the sheet P so as to melt the toner of the toner image with pressure, thereby fixing the toner image on the sheet P. Subsequently, the sheet P is sent from the fixing device 9 and ejected by the ejection rollers 10 to the outside of the image forming apparatus 1000.

After the transfer process, residual toner remaining on the photoconductor 1 is collected from the cleaning device 7. The surface of the photoconductor 1 is discharged with the electric discharger 8 in preparation for a subsequent image forming process. Incidentally, excess toner transferred on the sheet conveyance belt 12 is removed by a belt-cleaning device 15.

As illustrated in FIG. 3, the photoconductor 1, the developing device 6, the charging device 2, and the cleaning device 7 may be integrally supported in a process cartridge 100. The process cartridge 100 is detachably mountable to a main body of the image forming apparatus 1000. Accordingly, when components of the process cartridge 100 reach the end of their service life or need maintenance, the process cartridge 100 can be detached and replaced as a unit, which is more convenient for users.

Figure 4:
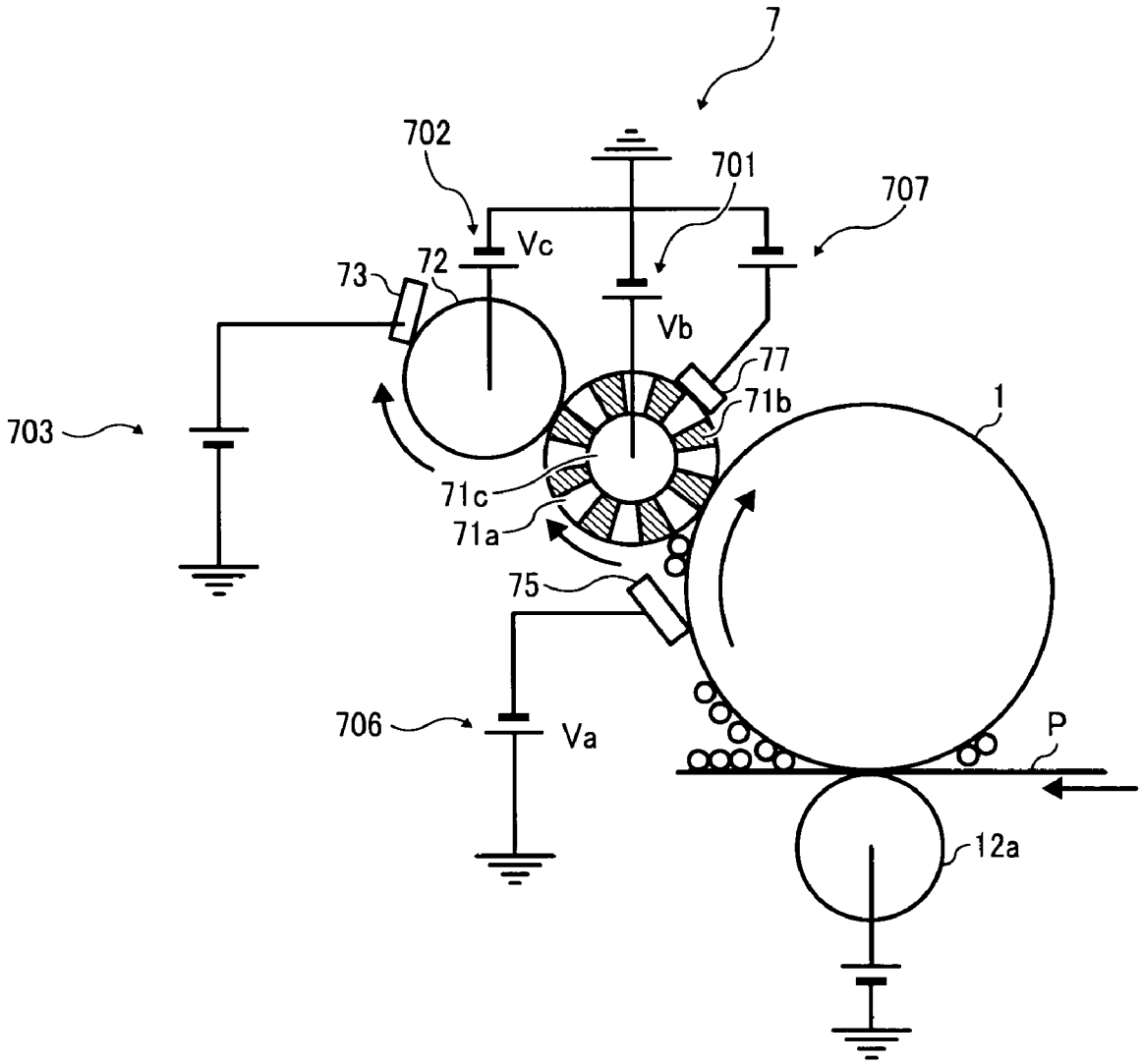
FIG. 4 illustrates a schematic configuration of a cleaning device provided in the image forming apparatus of FIG. 3 according to an exemplary embodiment.

FIG. 4 illustrates a schematic configuration of the cleaning device 7.

The cleaning device 7 has a brush roller 71 functioning as a cleaning member, a collection roller 72 functioning as a collection member, a scraper member 73 functioning as a separation member, a transport unit, not illustrated, and a polarity control member 75 and a power supply 706 functioning together as a polarity control unit.

The brush roller 71 has a core member 71*c* and numerous bristles 71*a* and 71*b* disposed on the surface of the core member 71*c*. The brush roller 71 brings the tips of the bristles 71*a* and 71*b* into contact with the photoconductor 1 and is rotated by a driving unit, not illustrated, in a clockwise direction in FIG. 4 so that, at the contact portion, the surface of the brush roller 71 moves in a direction opposite a moving direction of the surface of the photoconductor 1. Thus, the brush roller 71 catches the residual toner remaining on the surface of the photoconductor 1 by scraping the surface of the photoconductor 1 with the bristles 71*a* and 71*b*.

The collection roller 72 is disposed to sandwich the brush roller 71 between it and the photoconductor 1, and is rotated by a driving unit, not illustrated, in a clockwise direction of FIG. 4 so that the surface of the collection roller 72 moves in a direction opposite the moving direction of the surface of the brush roller 71.

The scraper member 73 has a plate shape, for example, with an edge portion thereof contacting the surface of the collection roller 72 with a certain pressure. The transport unit is disposed below the scraper member 73.

The polarity control member 75 receives a bias supplied from the power supply 706 and supplies an electric charge to the residual toner remaining on the surface of the photoconductor 1 to convert the polarity of the residual toner into the polarity of the bias supplied from the power supply 706. For example, when the normal charge polarity of toner is negative as in this exemplary embodiment, a portion of the toner may receive the action of a positive polarity bias at the transfer nip, and thus be positively charged.

Figure 5A:
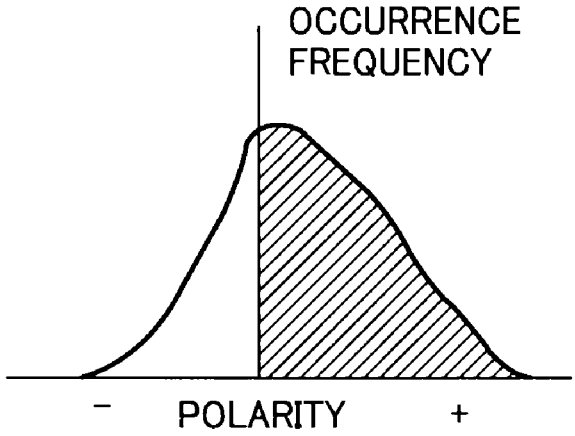
FIG. 5A is a graph illustrating a charging distribution of residual toner observed before passing through a portion facing a polarity control member in the cleaning device of FIG. 4.
Figure 5B:
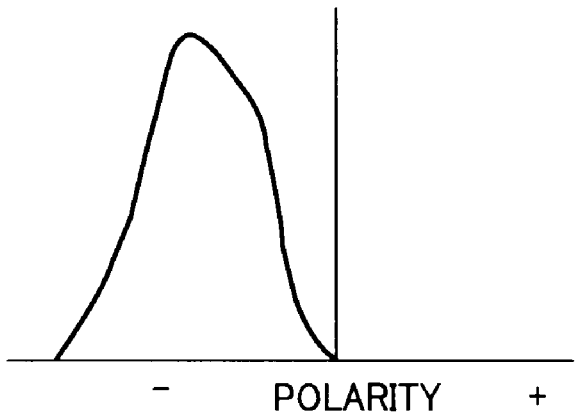
FIG. 5B is a graph illustrating a charging distribution of residual toner observed after passing through the portion facing the polarity control member of FIG. 5A.

As a result, the charging distribution of such residual toner may show a mix of negative-polarity toner and positive-polarity toner as illustrated in FIG. 5A. As described above, in this exemplary embodiment, the polarity of the bias supplied from the power supply 706 is negative. Accordingly, when such residual toner in which negative-polarity toner and positive-polarity toner are mixed receives an electric charge of negative polarity from the polarity control member 75, such residual toner is uniformly charged with negative polarity as illustrated in FIG. 5B.

Although in the present exemplary embodiment the polarity control member 57 is formed of a conductive blade, the polarity control member 57 may be a brush- or film-type member capable of charging while contacting such residual toner on the surface of the photoconductor 1.

Further, in the present exemplary embodiment, the polarity control member 57 is brought into contact with residual toner on the surface of the photoconductor 1 to supply an electric charge to the residual toner to give it a single polarity. It should be noted that another device, such as a charger, may be used to supply such electric charge to the residual toner, although the charging method described in the present exemplary embodiment is preferable because, for example, fewer discharge products which may adversely affect image formation are generated.

Incidentally, although in the present exemplary embodiment the residual toner is uniformized into negative polarity with the polarity control member 75, the image forming apparatus 1000 may have a configuration that the residual toner is uniformized into positive polarity.

As illustrated in FIG. 4, a power supply 701 is connected to a shaft portion of the brush roller 71 to supply a positive-polarity bias to the brush roller 71. The uniformly charged residual toner is electrostatically attracted onto the positive-polarity brush roller 71. As a result, the residual toner can be removed from the surface of the photoconductor 1.

Further, a power supply 702 is connected to a shaft portion of the collection roller 72 to supply a positive-polarity bias. The negative-polarity toner electrostatically attracted onto the brush roller 71 is collected to the collection roller 72 by utilizing an electric potential gradient between the brush roller 71 and the collection roller 72. The toner collected to the collection roller 72 is mechanically scraped away from the surface of the collection roller 72 with the scraper member 73. Such scraped toner is transported to a waste toner bottle, not illustrated, by the transport unit. Alternatively, such scraped toner may be transported to the developing device 6 for reuse.

If a surface layer of the collection roller 72 has a volume resistivity of, for example, approximately $10^5$ to $10^8 \Omega \cdot cm$, a slight amount of the residual toner on the surface of the photoconductor 1 may pass through a cleaning region at which the photoconductor 1 faces the brush roller 71, thereby resulting in a cleaning failure.

One possible cause thereof is as follows: When the toner electrostatically attracted to the brush roller 71 contacts the collection roller 72, the toner is charged with a polarity identical to that of the bias supplied to the collection roller 72. Consequently, some of the toner may return from the brush roller 71 to the surface of the photoconductor 1.

One method of preventing such cleaning failure is to form the surface layer of the collection roller 72 with an insulation layer. According to such method, when the collection roller 72 contacts the residual toner, an electric charge is prevented from being supplied from the collection roller 72 to the residual toner, thereby preventing such cleaning failure. Accordingly, in the present exemplary embodiment, the surface layer of the collection roller 72 is formed of such insulation layer.

The collection roller 72 has a metal core, that is, a shaft portion of metal material, and is produced by inserting the metal core into an insulation member of a hollow, circular cylindrical shape and by integrally molding the metal core and the insulation member. For example, the collection roller 72 can be easily produced by covering the metal core with a tube member of PET (polyethylene terephthalate), PFA (perfluoroalkoxy resin), copolymerization nylon, or the like.

As another production method, alumite treatment or Teflon (registered trademark) hard slumite treatment is performed on an aluminum core to obtain a insulated metal surface. Then, such metal surface is coated with an inorganic material such as ceramic, or an organic material such as a PTFE (polytetrafluoroethylene), polyimide, or polycarbonate.

If the surface layer of the collection roller 72 is relatively thick, a variation in temperature, humidity, or other ambient environmental conditions may generate a difference in expansion coefficient between the surface layer and the metal core or a variation in diameter of the metal core, thereby resulting in a crack or a boundary separation of the surface layer. Accordingly, the surface layer of the collection roller 72 preferably has a thickness of not more than 1 mm, more preferably not more than 0.5 mm.

However, in one observation regarding such configuration, when the surface layer of the collection roller 72 was formed of such insulation layer, a cleaning failure appeared on the surface of the photoconductor 1 over time. One possible cause is that a reduction in the intensity of the electrical field generated between the brush roller 71 and the collection roller 72 prevented the collection roller 72 from effectively collecting the toner attached to the brush roller 71. Meanwhile, no variation was observed in the bias value applied to the brush roller 72, and accordingly the bias value was maintained in a normal range. Then, when the surface potential of the collection roller 72 was measured, a decrease in the surface potential was observed over time.

A description is now given of collecting toner according to an electrostatic cleaning method.

Figure 6A:
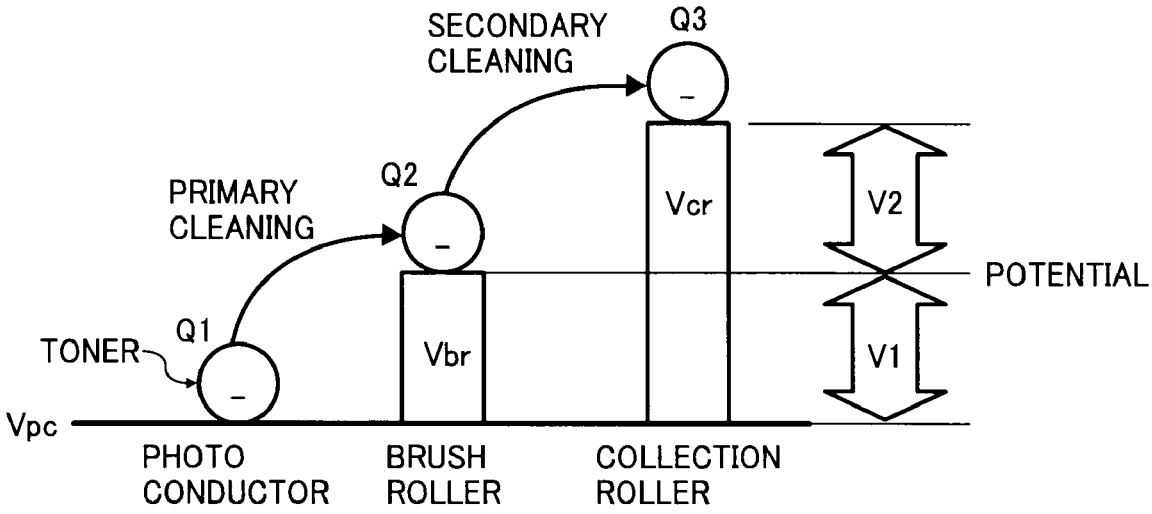
FIGS. 6A and 6B illustrate relations among transport of toner from the surface of a photoconductor to the surface of a collection roller, the surface potential Vpc of the photoconductor, the surface potential Vbr of a brush roller, and the surface potential Vcr of the collection roller.
Figure 6B:
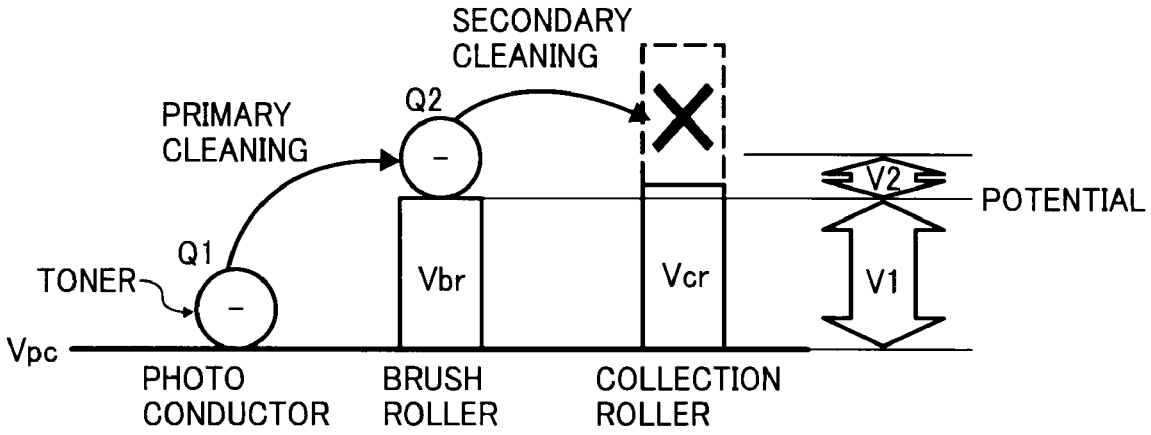

FIGS. 6A and 6B illustrate relations between the transportation of toner from the surface of the photoconductor 1, on one hand, to the surface of the collection roller 72, the surface potential Vpc of the photoconductor 1, the surface potential Vbr of the brush roller 71, and the surface potential Vcr of the collection roller 72 on the other.

The surface layer of the collection roller 72 is formed of an insulation layer. Toner is charged to have a negative polarity. Q1 represents a charge of toner on the photoconductor 1, Q2 represents a charge of toner on the brush roller 71, and Q3 represents a charge of the collection roller 72. The surface potential Vpc of the photoconductor 1 is set to 0V.

The toner on the photoconductor 1 is shifted to the brush roller 71 by an electrical field generated by an electric potential difference V1 (V1=Vbr) between the photoconductor 1 and the brush roller 71. Hereinafter, such toner shift is called "primary cleaning".

Further, the toner on the brush roller 71 is shifted to the collection roller 72 by an electrical field generated by an electric potential difference V2 (V2=Vcr−Vbr) between the brush roller 71 and the collection roller 72. Hereinafter, such toner shift is called "secondary cleaning".

In the secondary cleaning, when a sufficiently large electric-potential difference V2 is obtained between the brush roller 71 and the collection roller 72 as illustrated in FIG. 6A, an electrical field sufficient to shift the toner from the brush roller 71 to the collection roller 72 can be generated.

By contrast, a decrease in the surface potential of the collection roller 72 may reduce the electric potential difference V2 between the brush roller 71 and the collection roller 72 as illustrated in FIG. 6B. As a result, an electrical field sufficient to shift the toner from the brush roller 71 to the collection roller 72 cannot be generated between the brush roller 71 and the collection roller 72, thereby preventing the secondary cleaning from being effectively executed.

Hence, in one examination of the cause of such decrease in surface potential of the collection roller 72, when the toner on the collection roller 72 was removed from the collection roller 72 by the scraper member 73, a decrease in the surface potential of the collection roller 72 was observed. One possible cause of such decrease is that, when cleaning the toner on the collection roller 72, a relatively great level of separation discharge is generated, thereby accumulating a counter charge on the surface of the collection roller 72. Further, when the surface layer of the collection roller 72 is formed of an insulation layer as described above, the surface potential reduced by such counter charge may not be sufficiently restored by a bias supplied to the shaft portion of the collection roller 72, thereby resulting in a decrease in the surface potential of the collection roller 72 over time.

To prevent such decrease in the surface potential of the collection roller 72 over time, in the present exemplary embodiment, as illustrated in FIG. 4, a power supply 703 is connected to the scraper member 73 to supply electric charge of a polarity opposite that of the toner, which is the cleaning target of the brush roller 71.

For example, the power supply 703 supplies, through the scraper member 73 to the surface of the collection roller 72, a bias of approximately 400V to 800V higher than the bias supplied to the shaft portion of the collection roller 72. Alternatively, another type of charge supply unit may be used to supply an electric charge to the surface of the collection roller 72 instead of the scraper member 73.

Due to a similar cause, the surface potential of the brush roller 71 may decrease over time. Hence, in the present exemplary embodiment, to prevent such decrease, an electrode member 77 is connected to a power supply 707 and contacted against the surface of the brush roller 71 as illustrated in FIG. 4, thereby allowing an electric charge of the polarity opposite the polarity of the toner to be supplied to the surface of the brush roller 71.

For example, the power supply 707 supplies, through the electrode member 77 to the surface of the brush roller 71, a bias of approximately 200V to 500V higher than the bias supplied to the shaft portion of the brush roller 71. Alternatively, another type of charge supply unit may be used to supply electric charge to the surface of the collection roller 72 instead of the scraper member 73.

Figure 7:
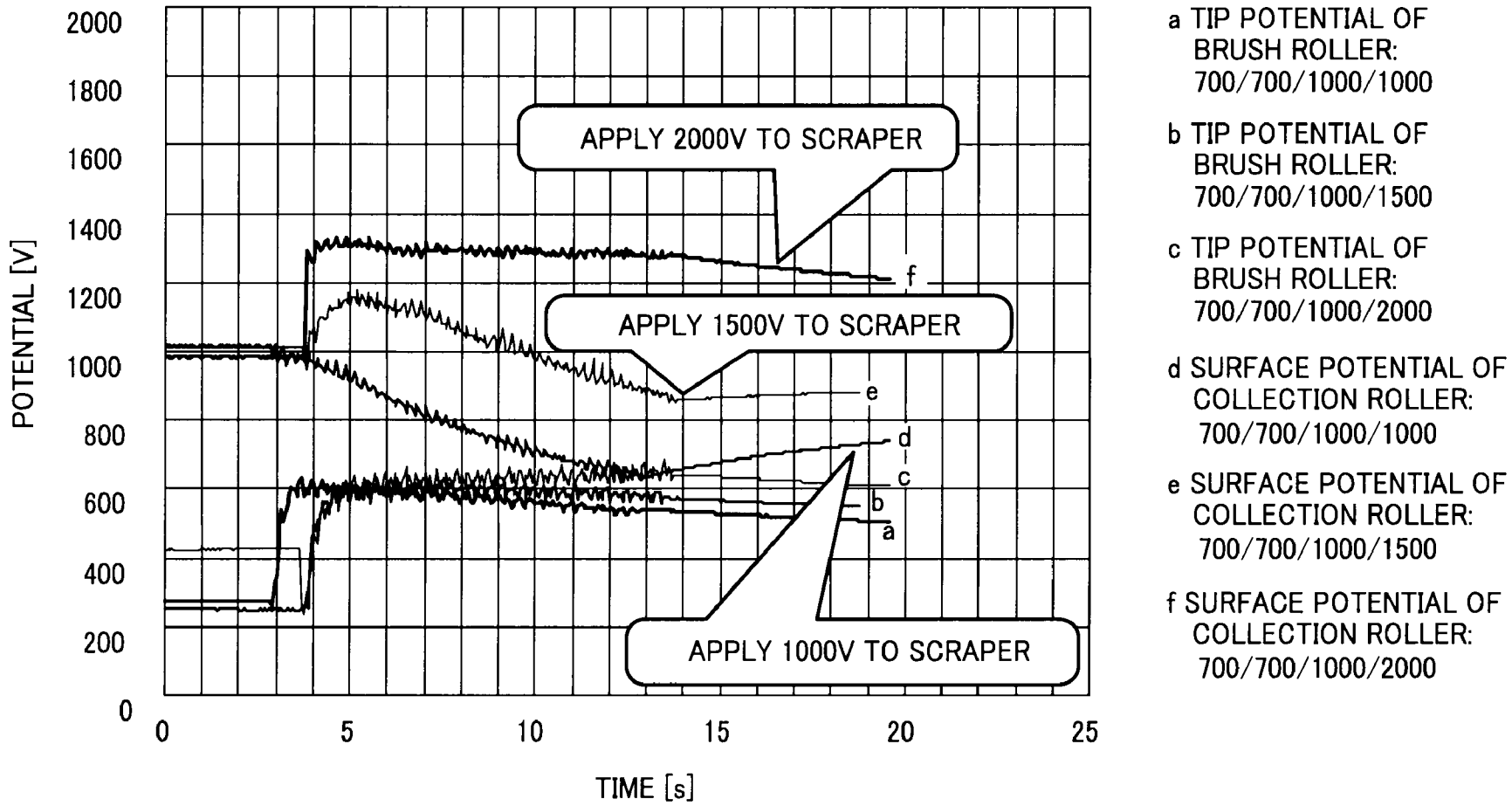
FIG. 7 is a graph illustrating a relation between the voltage applied to a scraper member and the surface potential of a collection roller.

FIG. 7 is a graph illustrating a relation between the voltage applied to the scraper member 73 and the surface potential of the collection roller 72. This graph also illustrates a relation between the surface potential of the brush roller 71 and each of the voltage applied to the scraper member 73 and the surface potential of the collection roller 72.

More specifically, the graph of FIG. 7 illustrates changes over time in the surface potential of the collection roller 72 when the voltage applied to the scraper member 73 is changed between 1000V, 1500V, and 2000V. In FIG. 7, the voltage applied to the brush roller 71 is set to 700V, and the voltage applied to the collection roller 72 is set to 1000V.

The graph of FIG. 7 indicates that with a relatively low voltage applied to the scraper member 73 the surface potential of the collection roller 72 decreases over time. As a result, the difference in surface potential between the collection roller 72 and the brush roller 71 decreases, thereby preventing the toner on the brush roller 71 from shifting to the collection roller 72.

By contrast, applying a sufficiently high voltage of, for example, approximately 2000V can prevent the surface potential of the collection roller 72 from decreasing. As a result, the difference in surface potential between the collection roller 72 and the brush roller 71 can be prevented from decreasing over time, thereby maintaining the collection efficiency of toner by the collection roller 72 at a preferable level over time.

In the present exemplary embodiment, the scraper member 73 performs the functions of separating or scraping toner from the surface of the collection roller 72 and supplying an electric charge to the surface of the collection roller 72. Preferably, the scraper member 73 is formed of an elastomer material, for example, polyurethane, silicone, or nitrile rubber, capable of obtaining a desired adherence to the surface of the collection roller 72. Further, to securely supply such electric charge to the surface of the collection roller 72, such elastomer material preferably has a volume resistivity of, for example, not more than 10Ω·cm. One method of obtaining such volume resistivity is to add carbon, filler metal, and/or ion conductive agent to the above-described elastomer material.

To obtain a preferable toner separating performance of the scraper member 73, the scraper member 73 needs to be appropriately contacted against the surface of the collection roller 72.

Figure 8:
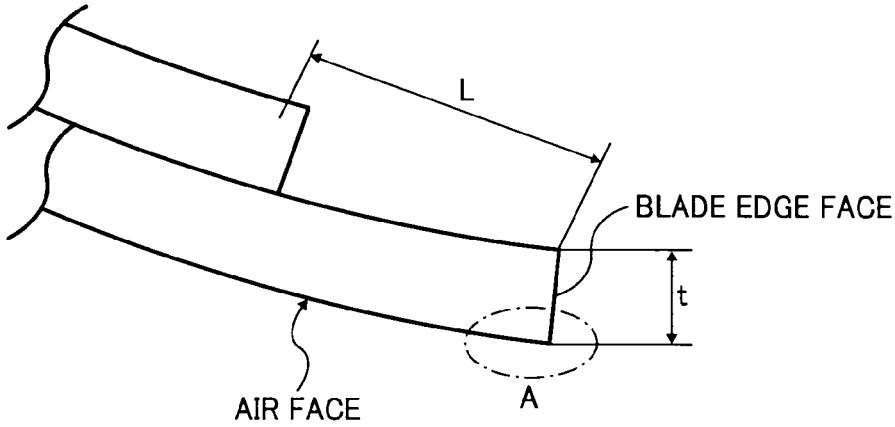
FIG. 8 is a schematic view illustrating a scraper member contacting the surface of the collection roller 72 in a counter manner, viewed from an axial direction of a collection roller.

FIG. 8 is a schematic view illustrating the scraper member 73 contacting the surface of the collection roller 72 according to the counter manner, viewed from an axial direction of the collection roller 72.

Figure 9:
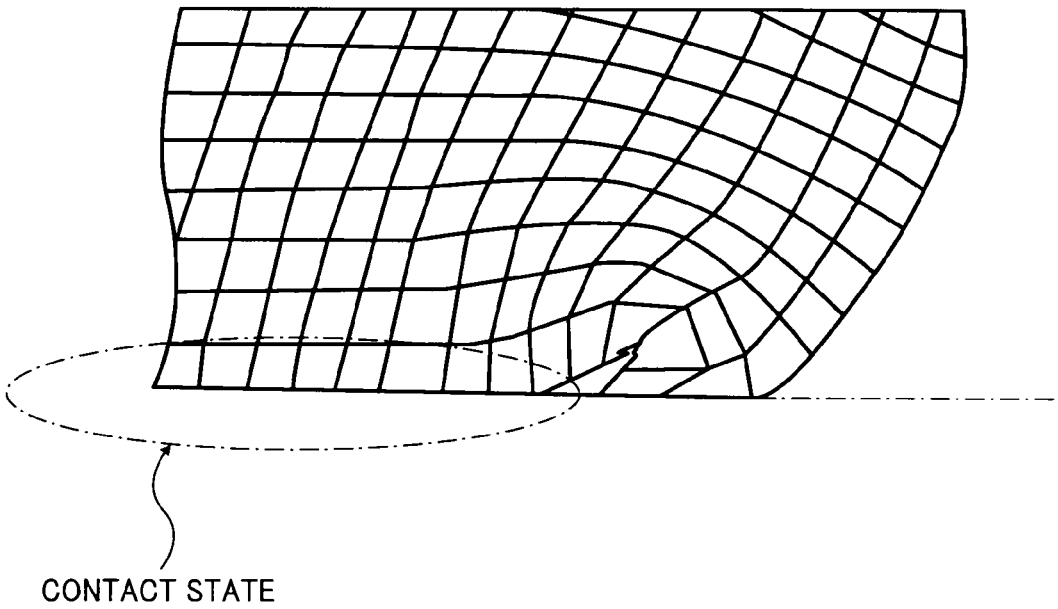
FIG. 9 is an enlarged view of a portion "A" in FIG. 8 when a belly portion of the scraper member is pressed against the surface of the collection roller.

FIG. 9 is an enlarged view of a portion indicated by "A" in FIG. 8 when the scraper member 73 presses against the collection roller 72. The portion "A" is a contact portion between the scraper member 73 and the collection roller 72.

Figure 10:
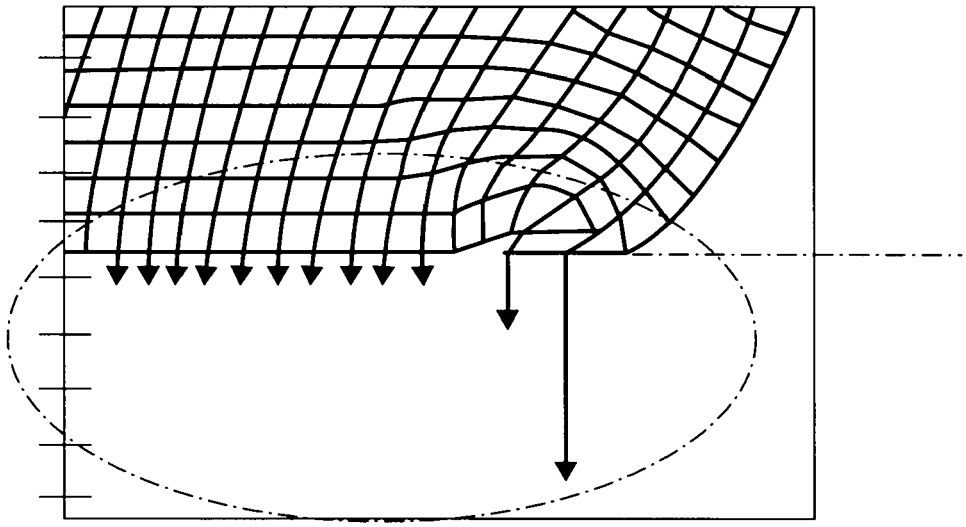
FIG. 10 illustrates pressure vectors of the scraper member at the state of FIG. 9.

FIG. 10 illustrates pressure vectors of the scraper member 73 in the state of FIG. 9.

Figure 11:
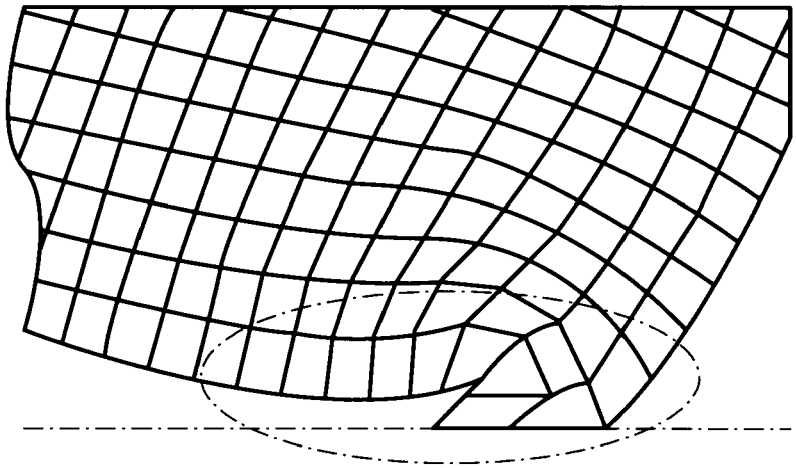
FIG. 11 is an enlarged view of the portion "A" in FIG. 8 when a belly portion of the scraper member is not pressed against the surface of the collection roller.

FIG. 11 is an enlarged view of the portion "A" in FIG. 8 when the scraper member 73 is not in contact with the collection roller 72.

Figure 12:
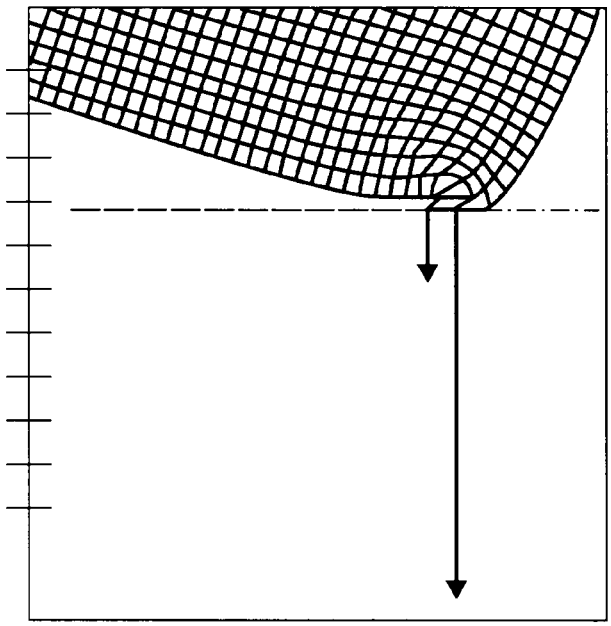
FIG. 12 illustrates pressure vectors of the scraper member at the state of FIG. 11.

FIG. 12 illustrates pressure vectors of the scraper member 73 in the state of FIG. 11.

More specifically, FIG. 9 illustrates a deformed state of the scraper member 73 having a blade thickness "t" of not more than 2.2 mm.

FIG. 11 illustrates a deformed state of the scraper member 73 having a blade thickness "t" of more than 2.2 mm. In all states, the scraper member 73 is pressed against the surface of the collection roller 72 with an identical pressure. In other words, the linear pressure applied to the scraper member 73 is the same in either of the states. Incidentally, the term "linear pressure" used herein refers to a value obtained by dividing the pressure applied to the scraper member 73 by the length of the scraper member 73 in the axial direction of the collection roller 72 at the contact portion between the scraper member 73 and the collection roller 72.

In the state illustrated in FIG. 9, the air face of the blade or scraper member 73 contacts the surface of the collection roller 72, thereby forming a so-called "belly contact state". By contrast, FIG. 11 is a state at which only an edge face of the scraper member 73 contacts the surface of the collection roller 72.

As illustrated in FIGS. 10 and 11, in the contact state of FIG. 11, a relatively great amount of pressure concentrates on the contact portion compared to the state of FIG. 10, thereby more effectively preventing toner from passing through the contact portion.

Increasing the linear pressure to be applied to the scraper member 73 may result in an increase in the deformation amount of the collection roller 72. In such case, since the collection roller 72 receives a weight from the scraper member 73 in a substantially horizontal direction, a middle portion of the collection roller 72 in its axial direction is considerably deformed.

Figure 13:
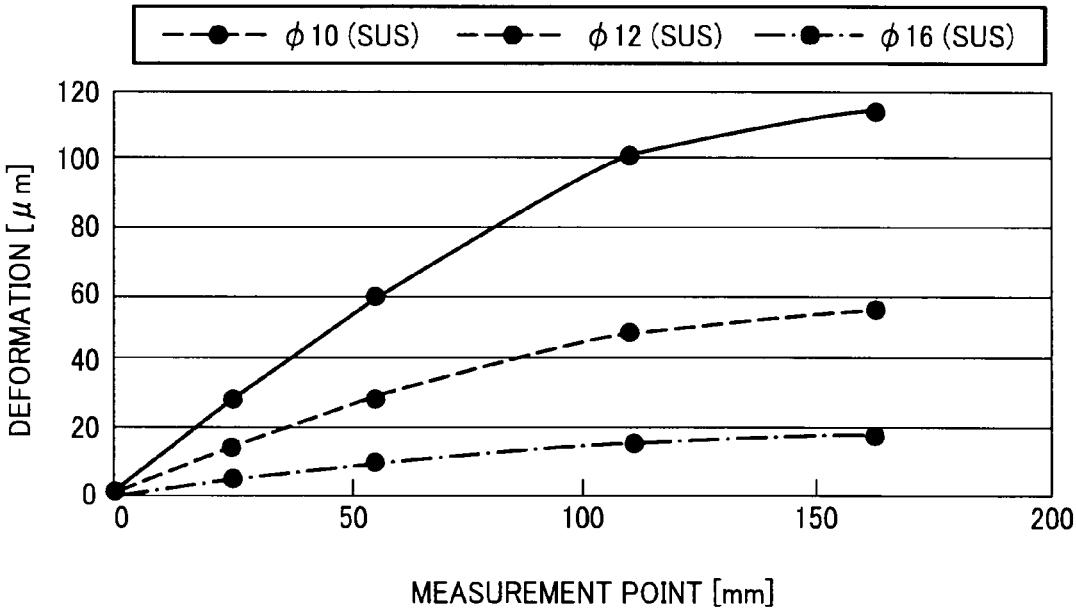
FIG. 13 is a graph illustrating deformation amounts of the collection roller.

FIG. 13 is a graph showing the deformation amount of the collection roller 71 observed when the scraper member 73 is pressed against the collection roller 72 having a length of 320 mm in its axial direction with a linear pressure of 50 g/cm. Incidentally, since the deformation amount of the collection roller 72 is symmetrical with respect to the middle portion in the axial direction of the collection roller 72, the deformation amount of only half the collection roller 72 is shown in FIG. 11.

In the graph of FIG. 13, the vertical axis represents the deformation amount of the collection roller 72, and the horizontal axis represents a distance from one end of the collection roller 72 to a measurement point. The metal core of the collection roller 72 is made of SUS (stainless used steel).

This graph indicates that, when the roller diameter of the collection roller 72 is not more than 10 mm, the maximum deformation amount of the collection roller 72 is more than 0.1 mm. Consequently, a difference in the cleaning performance of the scraper member 73 may be generated between the middle portion and each end portion of the collection roller 72 in its axial direction.

Hence, to prevent such difference from being generated, the relation between the linear pressure of the scraper member 73 and the diameter of the collection roller 72 is adjusted so that the deformation amount of the collection roller 72 may be not more than 0.1 mm.

In the above-described configuration in which an electric charge is supplied to the surface of the collection roller 72, the surface of the collection roller 72 may be degraded due to the scraping of the scraper member 73 and the discharge generated during the supply of such electric charge. As a result, the surface of the collection roller 72 may be degraded faster than the case where an electric charge is not supplied in such manner, thereby causing the surface of the collection roller 72 to be more easily roughened over time. Consequently, the friction coefficient between the surface of the collection roller 72 and the scraper member 73 may be reduced over time, thereby undesirably causing toner to more easily pass through the contact portion between the surface of the collection roller 72 and the scraper member 73 over time.

Next, a description is given of a mechanism by which increasing roughness of the surface of the collection roller 72 undesirably facilitates toner to pass through such contact portion.

Figure 14:
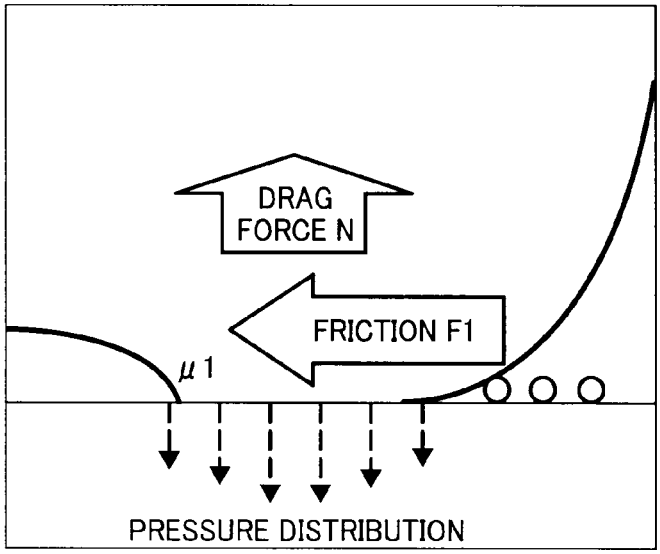
FIG. 14 is a schematic view illustrating an initial state of a contact portion between the surface of the collection roller and the scraper member.

FIG. 14 is a schematic view illustrating a state of the contact portion between the surface of the collection roller 72 and the scraper member 73 at an initial stage.

Figure 15:
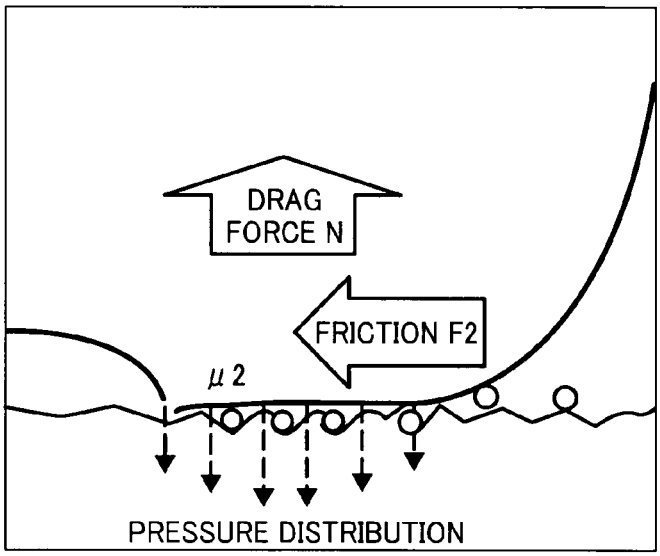
FIG. 15 is a schematic view illustrating a later state of the contact portion between the surface of the collection roller and the scraper member.

FIG. 15 is a schematic view illustrating a state of the contact portion between the surface of the collection roller 72 and the scraper member 73 at a given later stage sometime after the initial stage.

As illustrated in FIG. 14, the surface of the collection roller 72 is not rough at the initial stage. By contrast, at the later stage illustrated in FIG. 15, the surface of the collection roller 72 is roughened due to the scraping of the scraper member 73 and the discharge during the supply of electric charge through the scraper member 73.

Such increasing roughness of the surface of the collection roller 72 may reduce the friction coefficient μ between the surface of the collection roller 72 and the scraper member 73

($\mu 1 > \mu 2$), and also reduces the friction force F therebetween ($F1 > F2$). As a result, a portion of the toner on the surface of the collection roller 72 may go under the contact surface of the scraper member 73 and then pass through the contacting portion between the surface of the collection roller 72 and the scraper member 73.

Such passing toner is carried to another contact portion between the surface of the collection roller 72 and the brush roller 71 by the rotation of the collection roller 72. When passing through the second contact portion, such passing toner receives an electric charge, which may reverse the polarity of such passing toner to positive polarity. Such reversely-charged toner is shifted to the brush roller 71 at the second contact portion. Further, when being shifted to the contact portion between the surface of the photoconductor 1 and the brush roller 71 by the rotation of the brush roller 71, such reversely-charged toner may be shifted to the surface of the photoconductor 1 and then adhered to the surface of the photoconductor 1 as residual toner after cleaning.

To prevent such residual toner after cleaning from being generated over time, the roughness Ra of the surface of the collection roller 72 needs to be relatively low and also be maintained relatively low over time. In other words, the surface of the collection roller 72 needs to have a relatively high resistance to the scraping and discharge described above.

Next, a description is given of a relation between surface roughness Ra and cleaning failure.

Figure 16:
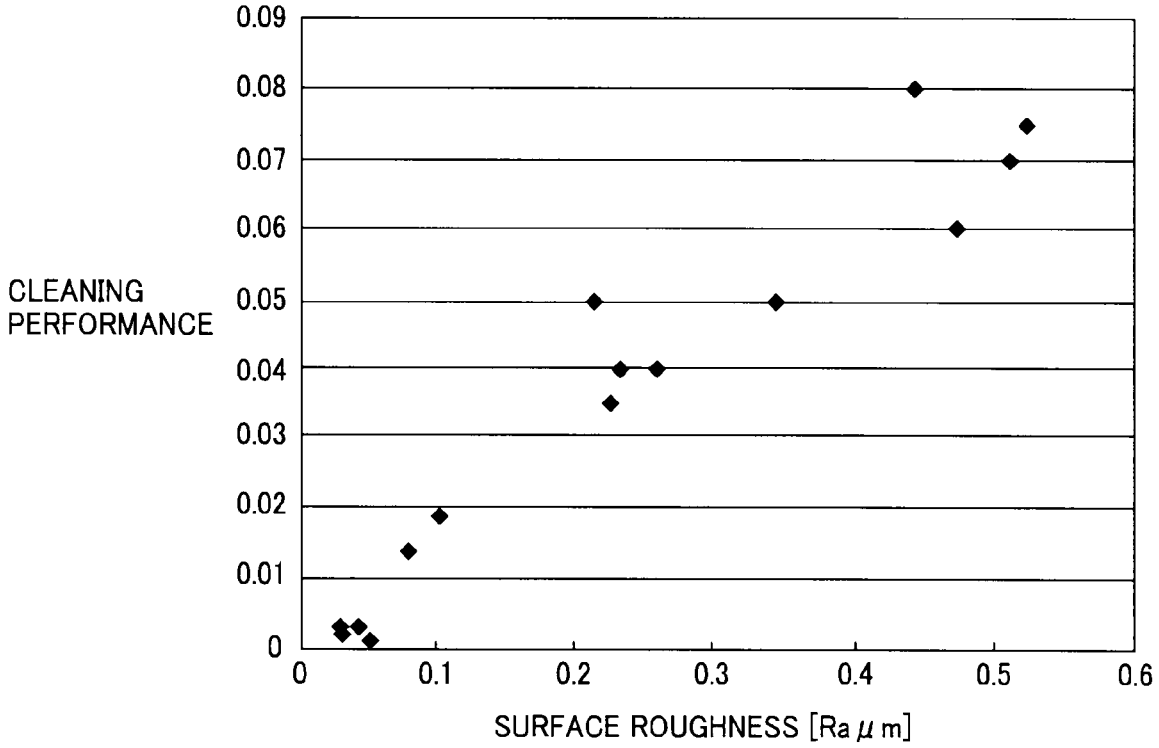
FIG. 16 is a graph illustrating relations between surface roughness and cleaning performance in various rollers usable as the collection roller.

FIG. 16 is a graph showing relations between surface roughness Ra and cleaning performance in various rollers usable as the collection roller 72.

In the graph of FIG. 16, the vertical axis represents scores of the cleaning performance of each roller, that is, measurement results of image density (ID) obtained by transferring residual toner, remaining on the surface of the collection roller 72 after passing the contact portion with the scraper member 73, to a tape member and then by attaching the tape to a sheet. The horizontal axis represents the surface roughness Ra of each roller.

A low score of the image density indicates a small amount of such residual toner, that is, a preferable cleaning performance. For example, scores of not more than 0.02 can prevent a cleaning failure from being generated. The surface roughness Ra in FIG. 16 was measured by using a SURFCOM 590A surface roughness meter from Tokyo Seimitsu Co., Ltd.

Next, a description is given of evaluation of the stability of low surface roughness Ra over time, that is, of the resistivity to damage due to scraping or discharge.

One index of the extent to which the surface of the collection roller 72 is resistant to scraping or discharge is evaluation results of a steel-wool scratch test. Such steel-wool scratch test is conducted by using a reciprocating abrasion resistance measurement device such as HEIDON TRIBOGEAR manufactured by Shinto Scientific Co., Ltd. The test conditions may be like those described below, for example.

A steel-wool pad has a size of 2 cm×2 cm, that is, a contact area of 4 $cm^2$. As the steel wool, for example, BONSTAR #0000 manufactured by Nihon Steel Wool Co., Ltd. is used.

In one test method, with the pressure of 250 $g/cm^2$ being applied to the steel wool pad, the steel wool pad was moved reciprocally over the surface of the collection roller 72 ten times, and then the number of scratch lines generated on the surface of the collection roller 72 was counted. The counted number of scratch lines was classified into one of several ranks illustrated in Table 1. Each rank indicates an evaluation result of each roller on the steel-wool scratch test.

TABLE 1

| RANK | NUMBER OF SCRATCH LINES |
|---|---|
| A | 0 |
| B | 1~10 |
| C | 10~20 |
| D | 20~ |

For the collection roller 72 showing a rank of B or higher in the evaluation result on this test, when the scraper member 73 is a blade made of a typical resin, no scratches were observed on the surface of the collection roller 72 after being scraped by the scraper member 73. The surface roughness of the collection roller 72 was maintained relatively low over time, thereby preventing cleaning failure from being generated over time.

Next, for 15 types of collection rollers having different types of surface materials, the surface roughness Ra was measured at an initial stage, and then the steel-wool scratch test was conducted. Further, the cleaning performance was evaluated at both the initial and later stages.

TABLE 2 shows evaluation results of the cleaning performance of the 15 types of collection rollers. The "later stage" used herein refers to a time after 150,000 sheets (on A4-size basis) pass through the transfer nip.

TABLE 2

| TYPE OF SURFACE | SURFACE ROUGHNESS | SCRATCH TEST | CLEANING PERFORMANCE | |
|---|---|---|---|---|
| MATERIAL | Ra | RANK | INITIAL | LATER |
| 1 | 0.522333 | A | 0.075 | 0.07 |
| 2 | 0.511333 | D | 0.07 | 0.2 |
| 3 | 0.471333 | D | 0.06 | 0.15 |
| 4 | 0.441 | A | 0.08 | 0.1 |
| 5 | 0.342667 | D | 0.05 | 0.09 |
| 6 | 0.259 | D | 0.04 | 0.13 |
| 7 | 0.232 | D | 0.04 | 0.166 |
| 8 | 0.226333 | D | 0.035 | 0.06 |
| 9 | 0.213 | B | 0.05 | 0.023 |
| 10 | 0.101667 | C | 0.019 | 0.03 |
| 11 | 0.079333 | B | 0.014 | 0.01 |
| 12 | 0.05 | A | 0.001 | 0.002 |
| 13 | 0.042667 | A | 0.003 | 0.001 |
| 14 | 0.030333 | B | 0.002 | 0.001 |
| 15 | 0.03 | D | 0.003 | 0.045 |

As illustrated in Table 2, each of the $10^{th}$ and $15^{th}$ collection rollers showed a considerably low surface roughness Ra at the initial stage and a poor cleaning performance at the later stage. On the other hand, in the evaluation results of surface hardness in the steel-wool scratch test, the 10th and 15th collection rollers showed ranks below B (rank C and rank D, respectively).

By contrast, each of the 11th to 14th collection rollers showed a considerably low surface roughness Ra at the initial stage and an excellent cleaning performance of not more than 0.02 at the later stage. In the evaluation results of surface hardness in this steel-wool scratch test, the 11th to 14th collection rollers showed ranks of B or higher (rank A and rank B.

Next, a description is given of a photoconductor used in the image forming apparatus 1000 according to the present exemplary embodiment.

The photoconductor 1 has a basic structure that includes a conductive support body, a latent image bearing layer, and a surface layer (protective layer). The latent image bearing layer should be chargeable and electrically insulating. For example, a non-photoconductive dielectric layer or a photoconductive photosensitive layer may be used as the latent image bearing layer.

Although the contact pressure of the brush roller 71 against the photoconductor 1 is considerably lower than in a conventional blade system, a high-speed rotation of the brush roller 71 may wear the surface of the photoconductor 1 over time. Accordingly, to secure a long service life, the protective layer of the photoconductor 1 may be preferably formed of a binder resin having a cross-linked structure. Further, a charge transport portion may be provided in the cross-linked structure of such binder resin, thereby enhancing its durability.

When such cross-linked structure of the binder resin is formed by using, for example, light or heat energy, a cross-linking reaction is generated in a reactive monomer having a plurality of cross-linking functional groups per molecule, thereby producing a three-dimensional mesh structure. Such mesh structure functions as the binder resin, and provides a relatively high abrasion resistance.

In view of its electrical stability, brushing resistance, and service life, all or a portion of the above-mentioned reactive monomer preferably has the transportability of an electric charge. With such reactive monomer, a charge transport portion can be formed inside the mesh structure, thereby providing excellent protection performance.

Such reactive monomer having charge transportability is, for example, a compound containing at least one charge transportable component and at least one silicon atom hydrolyzable substituent per molecule, a compound containing a charge transportable component and a hydroxyl group per molecule, a compound containing a charge transportable component and a carboxyl group per molecule, a compound containing a charge transportable component and an epoxy group per molecule, and a compound containing a charge transportable component and an isocyanate group per molecule.

Such charge transportable materials having these reactive groups may be used either alone or in combination of two or more materials thereof. More preferably, such reactive monomer having charge transportability may have a triarylamine structure because of high electrical and chemical stabilities and high carrier mobility.

Alternatively, as such reactive monomer, a polymerizable monomer and a polymerizable oligomer, each of which has one or two functional groups, may be combined to adjust its viscosity during coating, reduce the stress of the cross-linked charge transport layer, and/or reduce the surface energy and friction coefficient. In this regard, known polymerizable monomer and oligomer may be used as such polymerizable monomer and oligomer.

Further, the polymerization or cross linking of a hole transporting compound may be conducted with heat or light.

For the polymerization reaction with heat, the polymerization reaction may be initiated by heat only. Alternatively, an additional polymerization initiating agent may need to start the polymerization reaction. For example, to effectively proceed with the reaction at a lower temperature, such polymerization initiating agent is preferably used.

On the other hand, for the polymerization reaction with light, for example, preferably an ultraviolet light is used. However, the polymerization reaction seldom proceeds by light energy only, and accordingly a light-polymerization initiating agent is typically used. The light-polymerization initiating agent used herein primarily absorbs ultraviolet rays having wavelengths of not more than 400 nm to generate radicals, ions, or other active species, thereby initiating a polymerization reaction. The heat-polymerization initiating agent and the light-polymerization initiating agent described above may be used together.

The charge transport layer having such mesh structure has a high abrasion resistance, while may be subjected to a considerable decrease in volume contraction during cross-linking reaction. Consequently, an increase in the thickness of the charge transport layer may generate cracks in the charge transport layer. In such case, the protective layer may have a lamination structure including, for example, a lower protective sub-layer made of a low-molecular-weight dispersion polymer on the photosensitive layer side and an upper protective sub-layer having a cross-linked structure on the surface side.

For example, the photoconductor 1 may be produced with a coating liquid for the protective layer, a layer thickness. The production conditions are as follows.

For example, 182 parts of methyl trimethoxysilane, 40 parts of dihydroxymethyl triphenylamine, 225 parts of 2-propanol, 225 parts of 2% acetic acid, one part of aluminum tris acetylacetonate are mixed to prepare the coating liquid for the protective layer. The coating liquid is coated and dried on the charge transport layer, and then hardened by heat treatment under a temperature of 110° C. for one hour to form a protective layer of approximately 3 μm. Further, 30 parts of the hole transporting compound having a structural formula expressed by Formula 1 below, 0.6 part of acryl monomer having a structural formula expressed by Formula 2 below, and 0.6 part of a light-polymerization initiating agent, that is, 1-hydroxy-cyclhexyl-phenyl-keton are dissolved into a mixed solvent including 50 parts of monochlorobenzene and 50 parts of dichloromethane. A coating material for the surface protective layer is prepared and applied onto the charge transport layer according to a spray coating method. The coating material is hardened with a light intensity of 500 mW/cm$^2$ for 30 seconds by using a metal halide lamp to form a surface protective layer having a thickness of 5 μm.

[Formula 1]

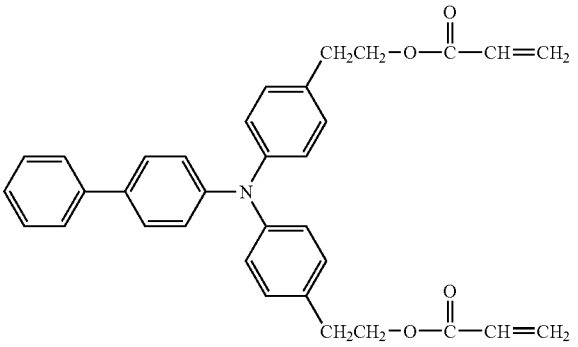

[Formula 2]

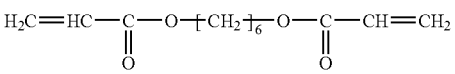

Next, a description is given of an example of toner used in the image forming apparatus 1000 according to the present exemplary embodiment.

Preferably, the toner has a shape factor SF1 of 100 to 150.

Figure 17:
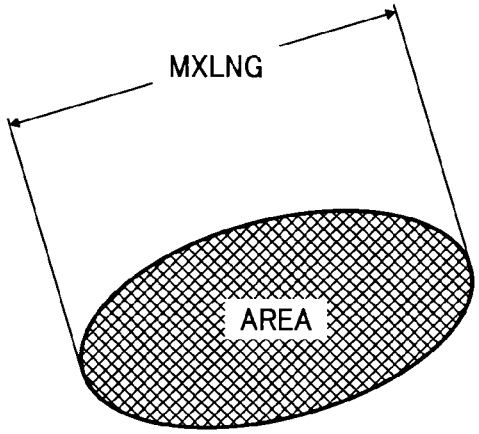
FIG. 17 is an illustration for explaining a method of calculating a shape factor SF1.

FIG. 17 is an illustration for explaining a method of calculating such shape factor SF1.

Figure 18:
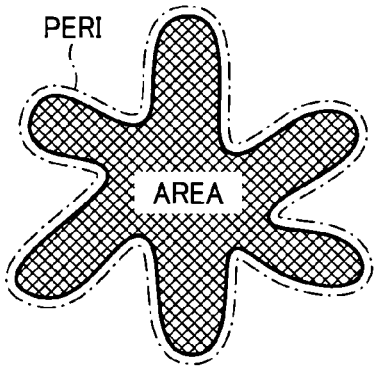
FIG. 18 is an illustration for explaining a method of calculating a shape factor SF2.

FIG. 18 is an illustration for explaining a method of calculating a shape factor SF2.

As illustrated in FIG. 17, the shape factor SF1 is a numeral value indicating the degree of roundness in the shape of a round material and is expressed by the following Equation 1.

$$SF1=\{(MXLNG)^2/AREA\}\times(100\pi/4) \quad [1]$$

where "MXLNG" represents a maximum length of an elliptical figure obtained by projecting such round material onto a two-dimensional plane, and "AREA" represents an area of the elliptical figure.

On the other hand, as illustrated in FIG. 18, the shape factor SF2 is a numerical value indicating the degree of irregularity in the shape of a material and is expressed by the following Equation 2.

$$SF2=\{(PELI)^2/AREA\}\times(100\pi/4) \quad [2]$$

where "PELI" represents a circumferential length of a figure obtained by projecting the material onto a two-dimensional plane, and "AREA" represents an area of the figure.

For the shape factor SF2, toner images are randomly sampled 100 times with FE-SEM (S-800) manufactured by HITACHI, Ltd, for example. The sampled images are input to and analyzed by LUZEX III image analyzer manufactured by Nikon Corporation, for example. Then, the shape factor SF2 is calculated by using the above Equation 2.

EXAMPLE 1

Next, an example (hereinafter, "Example 1") of the cleaning device 7 is described.

According to Example 1, the collection roller 72 has a metal core made of SUS having a diameter of 16 mm. The metal core is coated with a tube, such as a PVDF (poly vinyledene fluoride) tube manufactured by Okura Industrial Co., Ltd., having a thickness of 0.1 mm. Further, the tube is dipping-coated with an acrylic UV resin to produce the collection roller 72.

The surface layer of acrylic UV resin has a thickness of 5 μm and corresponds to the 13th surface material shown in Table 2. In Table 2, the surface layer Ra is 0.042667 μm, and the evaluation result of surface hardness in the steel-wool scratch test is rank "A".

For example, when the scraper member 73 having a blade thickness of 2.4 mm, a JIS-A hardness of 70°, and a free length L of 7 mm is pressed against the collection roller 72 with a linear pressure of 70 gf/cm, the deformation amount of the middle portion of the collection roller 72 was 0.01 mm.

The supply voltage Vbr which the power supply 701 supplies to the shaft portion of the brush roller 71 is 300V. The supply voltage Vbs which the power supply 707 supplies to the surface of the brush roller 71 is 300V. The supply voltage Vcr which the power supply 702 supplies to the shaft portion of the collection roller 72 is 800V. The supply voltage Vcs which the power supply 703 supplies to the surface of the scraper member 73 is 2000V.

The linear velocities of the photoconductor 1, the brush roller 71, and the collection roller 72 are 200 mm/s, 100 to 300 mm/s, and 100 to 300 mm/s, respectively. The brush roller 71 rotates in a counter direction with respect to the photoconductor 1, and the collection roller 72 rotates in a counter direction with respect to the brush roller 71.

Regarding Example 1, when the above-described cleaning performance of the cleaning device 7 was tested, an excellent cleaning performance of not more than 0.02 was maintained in any environment of a high-temperature, high-humidity environment of 32° C. and 80% RH (relative humidity) and a high-temperature, high-humidity environment of 10° C. and 15% RH. Further, such results of cleaning performance were maintained over time.

EXAMPLE 2

Next, another example (hereinafter, "Example 2") of the cleaning device 7 is described.

In Example 2, the collection roller 72 has the following configuration. That is, the collection roller 72 includes a metal core having a diameter of 16 mm and made of SUS. The surface of the metal core is fired with, for example, an inorganic ceramics of Atom Compobrid CSS-H produced by Atomix Co., Ltd., under a temperature of 120° C. for 30 minutes. Thus, a fine, robust matrix of inorganic siloxane is formed on the surface of the metal core.

The surface layer thus obtained has a thickness of 10 μm and corresponds to the 12th surface material of Table 2. In Table 2, the surface roughness Ra is 0.05 μm, and the evaluation result of surface hardness in the steel-wool scratch test is rank "A".

For example, when the scraper member 73 having a blade thickness of 2.4 mm, a JIS-A hardness of 70°, and a free length L of 7 mm was contacted with the surface of the collection roller 72 with a linear pressure of 70 gf/cm, the deformation amount of a middle portion of the collection roller 72 was 0.018 mm.

Alternatively, when the scraper member 73 having a blade thickness of 2.8 mm, a JIS-A hardness of 70°, and a free length L of 7 mm was contacted with the surface of the collection roller 72 with a linear pressure of 80 gf/cm, the deformation amount of a middle portion of the collection roller 72 was 0.01 mm.

The supply voltage Vbr which the power supply 701 supplies to the shaft portion of the brush roller 71 is 300V. The supply voltage Vbs which the power supply 707 supplies to the surface of the brush roller 71 is 300V. The supply voltage Vcr which the power supply 702 supplies to the shaft portion of the collection roller 72 is 800V. The supply voltage Vcs which the power supply 703 supplies to the surface of the scraper member 73 is 2000V.

The linear velocities of a photoconductor 1, the brush roller 71, and the collection roller 72 are 200 mm/s, 100 to 300 mm/s, and 100 to 300 mm/s, respectively. The brush roller 71 rotates in a counter direction with respect to the photoconductor 1, and the collection roller 72 rotates in a counter direction with respect to the brush roller 71.

Regarding Example 2, when the above-described cleaning performance of the cleaning device 7 was tested, an excellent cleaning performance of not more than 0.02 was maintained in any environment of a high-temperature, high-humidity environment of 32° C. and 80% RH (relative humidity) and a high-temperature, high-humidity environment of 10° C. and 15% RH. Further, such result of cleaning performance was maintained over time.

VARIATION EXAMPLE 1

Next, a variation example (hereinafter, Variation Example 1) of the cleaning device 7 is described.

Figure 19:
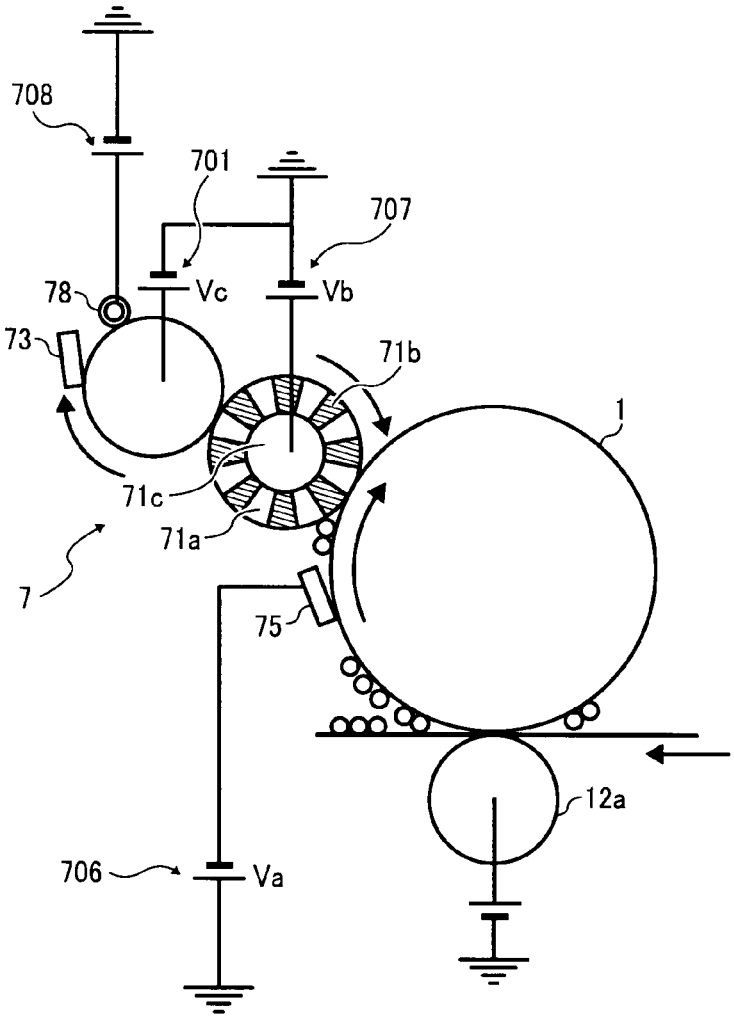
FIG. 19 is a schematic view illustrating a configuration of a variation example of the cleaning device.

FIG. 19 illustrates a schematic configuration of Variation Example 1 of the cleaning device 7.

The cleaning device 7 is provided with an electrode member 78 independently of the scraper member 73. A power supply 708 is connected to the electrode member 78 to charge the surface of the collection roller 72.

When the surface of the collection roller 72 is charged with the scraper member 73 as in the above-described exemplary embodiment, electrical discharge is induced between the scraper member 73 and the surface of the collection roller 72, thereby degrading the surface of the collection roller 72 and additionally a contact portion of the scraper 73 between it and the collection roller 72. Such degradation of the contact portion may reduce the coherence between the scraper member 73 and the surface of the collection roller 72, thereby reducing the cleaning performance.

According to Variation Example 1, the electrode member 78 independent of the scraper member 73 charges the surface of the collection roller 72, while the scraper member 73 does not charge the surface of the collection roller 72. As a result, electric discharge is not induced between the scraper member 73 and the surface of the collection roller 72. Accordingly, the contact portion of the scraper member 73 between it and the surface of the collection roller 72 is prevented from being degraded due to such discharge, thereby allowing preferable cleaning performance of the scraper member 73 to be maintained over time.

The electrode member 78 may be made of, for example, a SUS material, a conductive resin material, or a conductive rubber roller material having a diameter of 6 to 10 mm.

When the same level of voltage as that supplied to the scraper member 73 in Example 1 or 2 is supplied to the electrode member 78, cleaning performance similar to that of Example 1 or 2 was obtained.

VARIATION EXAMPLE 2

Next, another variation example (hereinafter, "Variation Example 2") of the cleaning device 7 is described.

Figure 20:
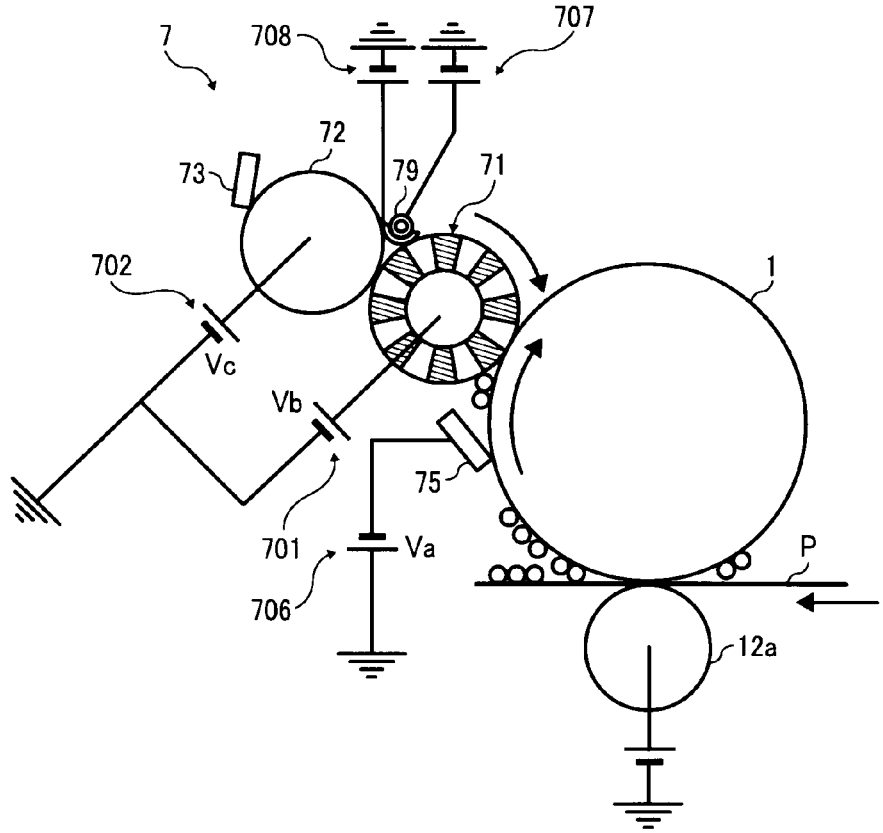
FIG. 20 is a schematic view illustrating a configuration of another variation example of the cleaning device.

FIG. 20 illustrates a schematic configuration of Variation Example 2 of the cleaning device 7.

For Variation Example 2, the surfaces of the brush roller 71 and the collection roller 72 are charged with a single electrode member 79. For example, the electrode member 79 is disposed at the vicinity of the contact portion between the brush roller 71 and the collection roller 72 so as to contact both surfaces of the brush roller 71 and the collection roller 72. The electrode member 79 has an insulating member and a conductive member, such as a phosphorus bronze plate or a stainless plate, which is laid on the insulating member. The insulating member and the conductive member are connected to the power supplies 707 and 708, respectively, thereby reducing the number of components.

In the above description, although the image bearing member is described as the photoconductor 1 having a drum shape, the cleaning device 7 is applicable to an image forming apparatus employing an image bearing member having another shape. For example, the cleaning device 7 is similarly applicable to an image forming apparatus including a belt-shaped photoconductor in which a belt is extended over two rollers so as to endlessly move.

In the image forming apparatus described above, the charge potential of the photoconductor 1 is negative and the developing device employs the reverse development method using the two-component developer. It should be noted that the charge potential of such photoconductor is not limited to negative polarity and may have positive polarity. Alternatively, such developing device may employ a single component developer or may be a normal development method.

Figure 21:
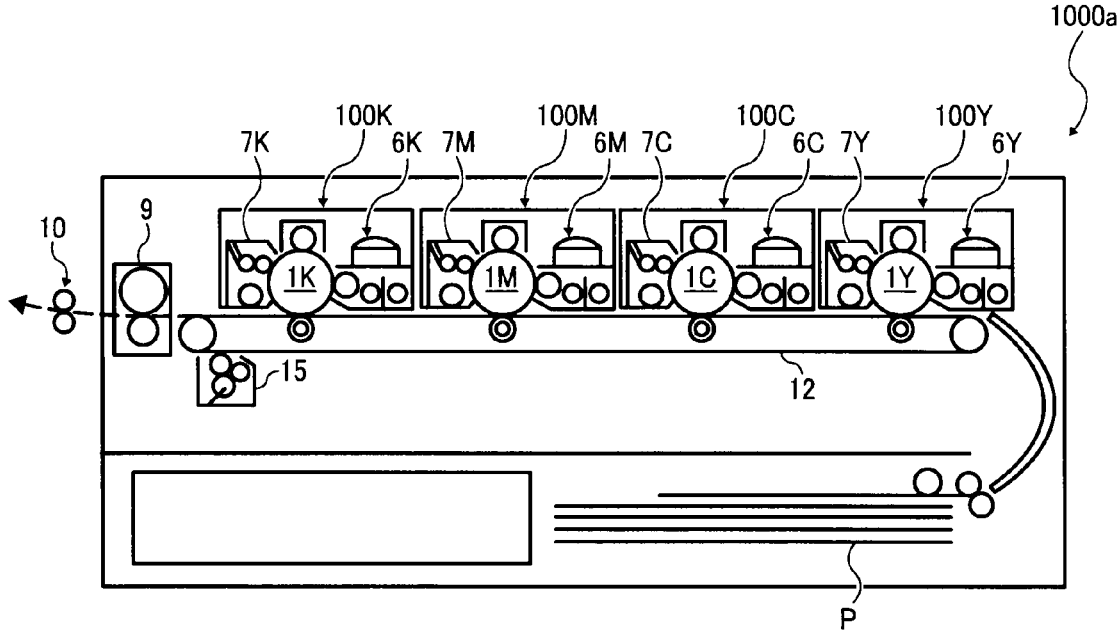
FIG. 21 is a schematic view illustrating a configuration of a tandem-type color image forming apparatus according to an exemplary embodiment.

In the above description, although the cleaning device is applied to the monochrome image forming apparatus having a single process cartridge, the cleaning device is applicable to other types of image forming apparatus. For example, such cleaning device is applicable to a color image forming apparatus having a tandem-type image forming section in which four process cartridges 100Y, 100C, 100M, and 100K are arranged in tandem as illustrated in FIG. 21.

Further, the cleaning device is applicable to an image forming apparatus employing an intermediate transfer method in which a toner image on a photoconductor is transferred onto an intermediate transfer member, and then the toner image on the intermediate transfer member is transferred onto a transfer sheet. In such case, the cleaning device may be used as any of a cleaning device that removes residual toner remaining on the intermediate transfer belt after the transfer process and a cleaning device for the intermediate transfer belt that removes residual toner remaining on the intermediate transfer belt. Such intermediate transfer body may have a belt shape or a drum shape. The electrical characteristic such as volume resistivity or surface resistivity, thickness, structure such as single-, dual-, three or more layer, material of such intermediate transfer body may be appropriately selected according to imaging conditions.

As described above, the cleaning device 7 according to the present exemplary embodiment has the brush roller 71, the collection roller 72, the power supplies 701, 702, 703, 707, and 708, and the scraper member 73. The brush roller 71 functions as a cleaning member that removes toner of a predetermined polarity (negative polarity in the above description) remaining on the surface of the photoconductor by moving its surface so as to contact the surface of the photoconductor, which is the target of the cleaning operation. The collection roller 72 functions as the collection member that collects toner adhered to the surface of the brush roller 71 by moving its surface so as to contact the surface of the brush roller 71.

Each of the power supplies 701, 702, 703, 707, and 708 functions as the electrical field generator that generates an electrical field to shift toner on the brush roller 71 to the collection roller 72 at the contact portion between the brush roller 71 and the collection roller 72. The scraper member 73 is disposed to press against the surface of the collection roller 72 so as to function as a separation member that separates toner adhered to the surface of the collection roller 72 from the surface of the collection roller 72. For the collection roller 72, the centerline average surface roughness Ra is not more than 0.1 μm, and the evaluation result of its surface hardness by the steel-wool scratch test is rank B or higher.

Such configuration allows the friction coefficient between the surface of the collection roller 72 and the scraper member 73 to be maintained relatively high over time, thereby preventing a cleaning failure from occurring on the surface of the collection roller 72 in the long term.

Further, according to the present exemplary embodiment, the surface layer of the collection roller 72 is made of an insulating layer, and the cleaning device 7 has an electric-charge supply unit that charges the surface of the collection roller 72 by applying, to the scraper member 73, a bias having a polarity opposite the predetermined polarity (here, negative polarity). Such configuration can prevent such a failure as a reduction over time of the surface potential of the collection roller 72 due to the configuration that the surface of the collection roller 72 is made of the insulating layer. Further, an electric charge is supplied using the scraper member 73, thereby reducing the number of components compared to the case where the cleaning device 7 has a specific member for supplying an electric charge to the surface of the collection roller 72.

In the cleaning device 7, the surface layer of the collection roller 72 has a thickness of not more than 1 mm. Accordingly, the surface layer is relatively stable with respect to an environmental change under a typical use condition.

Further, the scraper member 73 is made of an elastomer material and is configured as a blade member having a volume resistivity of not more than $10^{12}\Omega\cdot$cm. Such configuration provides excellent adherence between the scraper member 73 and the surface of the collection roller 72, thereby providing preferable cleaning performance. Such configuration also allows an electric charge to be supplied to the surface of the collection roller 72 using the scraper member 73.

According to the present exemplary embodiment, the scraper member 73 is formed of a blade member having a thickness of more than 2.2 mm. The scraper member 73 is pressed against the surface of the collection roller 72 with a linear pressure of more than 50 gf/cm. Such configuration can prevent the scraper member 73 from contacting the surface of the collection roller 72 at the so-called "belly contact state" described above. As a result, the scraper member 73 can maintain a preferable contact state between it and the surface of the scraper member 73, thereby providing excellent cleaning performance.

Further, in the present exemplary embodiment, the cleaning device 7 is configured so that the deformation amount of the collection roller 72 due to the contact between it and the scraper member 73 be not more than 0.1 mm. Such configuration can prevent a variation from occurring in the cleaning performance in the axial direction of the collection roller 72.

Examples and embodiments being thus described, it should be apparent to one skilled in the art after reading this disclosure that the examples and embodiments may be varied in many ways. Such variations are not to be regarded as a departure from the spirit and scope of the present invention, and such modifications are not excluded from the scope of the following claims.

What is claimed is:

1. A cleaning device that removes toner on a cleaning target, comprising:

a cleaning member which includes a brush, the cleaning member having a surface capable of moving while contacting a surface of the cleaning target to remove toner having a given polarity on the surface of the cleaning target;

a first power supply which supplies power to a core of the cleaning member in order to charge the cleaning member to attract toner from the cleaning target;

a collection member having a surface capable of moving while contacting the surface of the cleaning member to collect the toner attached to the surface of the cleaning member;

an electrical field generator configured to generate an electrical field to move the toner attached to the surface of the cleaning member from the cleaning member to the collection member at a contact portion between the cleaning member and the collection member;

an electrode which contacts an outer surface of the cleaning member;

a second power supply, connected to the electrode, which supplies power to the electrode in order to charge the cleaning member to a polarity opposite to the toner on the cleaning target; and a separation member disposed to contact the surface of the collection member to separate the toner attached to the surface of the collection member from the surface of the collection member.

2. The cleaning device according to claim 1, further comprising a charge supply unit configured to apply a bias having a polarity opposite the given polarity of the toner to the separation member to supply an electric charge to the surface of the collection member, wherein the collection member has an insulating layer on the surface thereof.

3. The cleaning device according to claim 2, wherein the insulating layer of the collection member has a thickness of not more than one millimeter.

4. The cleaning device according to claim 1, wherein the separation member is made of an elastomer material and comprises a blade member having a volume resistivity of not more than $10^{12}\Omega\cdot$cm.

5. The cleaning device according to claim 1, wherein the separation member comprises a blade member having a thickness of not less than 2.2 millimeters and is disposed to contact the surface of the collection member with a linear pressure of not less than 50 gf/cm.

6. The cleaning device according to claim 1, wherein a deformation amount of the collection member due to the contact with the separation member is not more than 0.1 millimeter.

7. An image forming apparatus, comprising:

an image bearing member having a movable surface;

an image forming unit configured to form a toner image on the surface of the image bearing member;

a cleaning device configured to remove toner on the surface of the image bearing member; and a transfer unit configured to transfer the toner image on the surface of the image bearing member to a recording medium to form a final image on the recording medium, the cleaning device comprising:

a cleaning member which includes a brush, the cleaning member having a surface capable of moving while contacting the surface of the image bearing member to remove toner having a given polarity on the surface of the image bearing member;

a first power supply which supplies power to a core of the cleaning member in order to charge the cleaning member to attract toner from the image bearing member;

a collection member having a surface capable of moving while contacting the surface of the cleaning member to collect the toner attached to the surface of the cleaning member;

an electrical field generator configured to generate an electrical field to move the toner attached to the surface of the cleaning member from the cleaning member to the collection member at a contact portion between the cleaning member and the collection member;

an electrode which contacts an outer surface of the cleaning member;

a second power supply, connected to the electrode, which supplies power to the electrode in order to charge the cleaning member to a polarity opposite to the toner on the image bearing member; and a separation member disposed to contact the surface of the collection member to separate the toner attached to the surface of the collection member from the surface of the collection member.

8. The image forming apparatus according to claim 7, wherein the toner has a shape factor SF1 of approximately 100 to approximately 150, the shape factor SF1 expressed by $$SF1=\{(MXLNG)^2/AREA\}\times(100\pi/4)$$

where MXLNG represents a maximum length of an elliptical figure obtained by projecting a round material onto a two-dimensional plane, and AREA represents an area of the elliptical figure.

9. The image forming apparatus according to claim 7, wherein the image bearing member is a photoconductor having a protective layer, the protective layer including a binder resin having a bridge structure.

10. The image forming apparatus according to claim 9, wherein the bridge structure of the binder resin includes a charge transporting portion.

11. The image forming apparatus according to claim 7, further comprising a process cartridge detachably mounted to the image forming apparatus and configured to integrally hold the image bearing member and the cleaning device.

12. A process cartridge detachably mountable to an image forming apparatus, the process cartridge comprising:

an image bearing member having a movable surface; and a cleaning device configured to remove toner attached to the surface of the image bearing member, wherein the cleaning device and the image bearing member are integrally held in the process cartridge, the cleaning device comprising:

a cleaning member which includes a brush, the cleaning member having a surface capable of moving while contacting the surface of the image bearing member to remove toner having a given polarity on the surface of the image bearing member;

a first power supply which supplies power to a core of the cleaning member in order to charge the cleaning member to attract toner from the image bearing member;

a collection member having a surface capable of moving while contacting the surface of the cleaning member to collect the toner attached to the surface of the cleaning member;

an electrical field generator configured to generate an electrical field to move the toner attached to the surface of the cleaning member from the cleaning member to the collection member at a contact portion between the cleaning member and the collection member;

an electrode which contacts an outer surface of the cleaning member;

a second power supply, connected to the electrode, which supplies power to the electrode in order to charge the cleaning member to a polarity opposite to the toner on the image bearing member; and a separation member disposed to contact the surface of the collection member to separate the toner attached to the surface of the collection member from the surface of the collection member.

13. The cleaning device according to claim 1, further comprising:

an electrode which contacts the cleaning target; and a third power supply, connected to the electrode which contacts the cleaning target, and supplies power to the electrode which contacts the cleaning target to charge the toner on the cleaning target.

14. The cleaning device according to claim 1, wherein:

the collection member has a centerline average surface roughness of not more than 0.1 μm, and the collection member has a hardness such that when steel wool having a contact area of 4 $cm^2$ is moved reciprocally ten times across the collection member, a number of scratch lines generated on the surface of the collection member is 10 or less.

15. The image forming apparatus according to claim 7, wherein:

the collection member has a centerline average surface roughness of not more than 0.1 μm, and the collection member has a hardness such that when steel wool having a contact area of 4 $cm^2$ is moved reciprocally ten times across the collection member, a number of scratch lines generated on the surface of the collection member is 10 or less.

16. The process cartridge according to claim 12, further comprising:

an electrode which contacts the image bearing member; and a third power supply, connected to the electrode which contacts the image bearing member, and supplies power to the electrode which contacts the image bearing member to charge the toner on the image bearing member.

17. The process cartridge according to claim 12, wherein:

the collection member has a centerline average surface roughness of not more than 0.1 μm, and the collection member has a hardness such that when steel wool having a contact area of 4 $cm^2$ is moved reciprocally ten times across the collection member, a number of scratch lines generated on the surface of the collection member is 10 or less.

18. The cleaning device according to claim 1, wherein the first and second power supplies are different power supplies.

19. The cleaning device according to claim 7, wherein the first and second power supplies are different power supplies.

* * * * *